US009726998B1

(12) United States Patent
Morooka et al.

(10) Patent No.: US 9,726,998 B1
(45) Date of Patent: Aug. 8, 2017

(54) ELECTROSTATIC CHARGE IMAGE DEVELOPER, DEVELOPER CARTRIDGE, AND PROCESS CARTRIDGE

(71) Applicant: FUJI XEROX CO., LTD., Tokyo (JP)

(72) Inventors: Yasuhisa Morooka, Kanagawa (JP); Hiroyoshi Okuno, Kanagawa (JP); Satoshi Inoue, Kanagawa (JP); Yoshifumi Iida, Kanagawa (JP); Tomohito Nakajima, Kanagawa (JP); Yuka Zenitani, Kanagawa (JP); Yoshifumi Eri, Kanagawa (JP); Takeshi Iwanaga, Kanagawa (JP); Sakae Takeuchi, Kanagawa (JP); Shunsuke Nozaki, Tokyo (JP); Yasuo Kadokura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/207,770

(22) Filed: Jul. 12, 2016

(30) Foreign Application Priority Data

Feb. 10, 2016 (JP) ..... 2016-024113

(51) Int. Cl.

| | |
|---|---|
| ***G03G 9/107*** | (2006.01) |
| ***G03G 9/113*** | (2006.01) |
| ***G03G 21/18*** | (2006.01) |
| ***G03G 9/08*** | (2006.01) |
| ***G03G 9/097*** | (2006.01) |

(52) U.S. Cl.
CPC ..... *G03G 9/1132* (2013.01); *G03G 9/0825* (2013.01); *G03G 9/09716* (2013.01); *G03G 9/09725* (2013.01); *G03G 9/1075* (2013.01); *G03G 21/18* (2013.01)

(58) Field of Classification Search
CPC ..... G03G 9/09725; G03G 9/09716; G03G 9/1075; G03G 9/1132; G03G 9/113; G03G 9/1139
USPC ..... 430/108.7
See application file for complete search history.

(56) References Cited

U.S. PATENT DOCUMENTS

| | | | | |
|---|---|---|---|---|
| 6,316,155 | B1 | 11/2001 | Kudo et al. | |
| 7,650,104 | B2 * | 1/2010 | Baba | G03G 15/0812 399/274 |
| 2007/0243479 | A1 * | 10/2007 | Yoshihara | G03G 9/10 430/110.3 |
| 2012/0129087 | A1 * | 5/2012 | Iwami | G03G 9/107 430/106.2 |
| 2014/0370427 | A1 * | 12/2014 | Sasaki | G03G 9/09725 430/105 |

FOREIGN PATENT DOCUMENTS

| | | |
|---|---|---|
| JP | 2000-330328 A | 11/2000 |

* cited by examiner

*Primary Examiner* — Janis L Dote
(74) *Attorney, Agent, or Firm* — Oliff PLC

(57) ABSTRACT

An electrostatic charge image developer includes an electrostatic charge image developing toner that includes toner particles, and an external additive which is added to the toner particles and which includes silica particles whose compression aggregation degree is from 60% to 95% and particle compression ratio is from 0.20 to 0.40, and a carrier for developing an electrostatic charge image that has a core including a magnetic member in a binder resin for a core and a coating layer which coders a surface or the core and which includes a resin for a coating layer and has a surface roughness Ra of from 0.25 μm to 0.4 μm.

13 Claims, 3 Drawing Sheets

ELECTROSTATIC CHARGE IMAGE DEVELOPER, DEVELOPER CARTRIDGE, AND PROCESS CARTRIDGE

CROSS-REFERENCE TO RELATED APPLICATIONS

This application is based on and claims priority under 35 USC 119 from Japanese Patent Application No. 2016-024113 filed Feb. 10, 2016.

BACKGROUND

1. Technical Field

The present invention relates to an electrostatic charge image developer, a developer cartridge, and a process cartridge.

2. Related Art

Currently, a method for visualizing image information through an electrostatic charge image by electrophotography or the like is used in various fields. In the electrophotography, image information is visualized as an image via a transferring step in which the image information is formed on the surface of an image holding member (a photoreceptor) by charging and irradiating steps as an electrostatic charge image, and a toner image is developed on the surface of a photoreceptor using a developer including a toner to transfer this toner image on a recording medium such as paper; and a fixing step in which the toner image is fixed on the surface of the recording medium. In addition, as the toner, a toner in which various external additives are added to toner particles is used.

SUMMARY

According to an aspect of the invention, there is provided an electrostatic charge image developer including:

an electrostatic charge image developing toner that includes toner particles, and an external additive which is added to the toner particles and which includes silica particles whose compression aggregation degree is from 60% to 95% and particle compression ratio is from 0.20 to 0.40; and a carrier for developing an electrostatic charge image that has a core including a magnetic member in a binder resin for a core and a coating layer which covers a surface of the core and which includes a resin for a coating layer and has a surface roughness Ra of from 0.25 μm to 0.4 μm.

BRIEF DESCRIPTION OF THE DRAWINGS

Exemplary embodiments of the present invention will be described in detail based on the following figures, wherein.

DETAILED DESCRIPTION

Hereinafter, the exemplary embodiment will be described as one example of the invention.

Electrostatic Charge Image Developer

An electrostatic charge linage developer according to the exemplary embodiment includes an electrostatic charge image developing toner (hereinafter, simply referred to as a "toner") having toner particles and an external additive added to the toner particles, and a carrier for developing an electrostatic charge image (hereinafter, simply referred to as a "carrier") .

The carrier has a core including a core resin (a binder resin for a core) and a magnetic member in the core resin, and a coating layer coating the surface of the core, including a coating resin (a resin for a coating layer), and having the surface roughness Ra from 0.25 μm to 0.4 μm. Also, the resin used for the binder resin as the core resin and the coating resin used may be the same as or different from each other.

An external additive includes silica particles (hereinafter, referred to as a "specific silica particles") whose compression aggregation degree is from 60% to 95%, and particle compression ratio is from 0.20 to 0.40.

Even in a case where the developer according to the exemplary embodiment uses a carrier satisfying the above requirement, occurrence of deletion in an image (image defect) is prevented by adding the specific silica particles to the toner particles. The reason is presumed as follows.

In the related art, as the carrier of the developer, a carrier (a magnetic member dispersing type resin coated carrier), in which the surface of the core (a so-called magnetic member dispersing type core) having the magnetic member such as magnetite dispersed in the core resin is coated with a coating layer (a resin coated layer) including a coating resin, is used. In addition, the magnetic member dispersing type resin coated carrier has properties, in which the magnetic member dispersing type core includes an almost smooth surface, the film thickness of the resin coated layer formed on the surface thereof is almost uniform, and as a result, the surface has less ruggedness and less undulations (difference in height), in other words, almost smooth surface. Specifically, in the exemplary embodiment, the surface roughness Ra of the carrier surface is from 0.25 μm to 0.4 μm.

Here, the silica particles added to the toner particles may flake from the toner particles due to mechanical load caused stirring within a developing unit, and the silica particles flaked from the toner may be attached to the surface of the carrier. Since the magnetic member dispersing type resin coated carrier has an almost smooth surface, it is preferable that the flaked external additive is hardly attached to the surface and hardly kept as it is ever if the external additive is attached to the surface.

Figure 1:
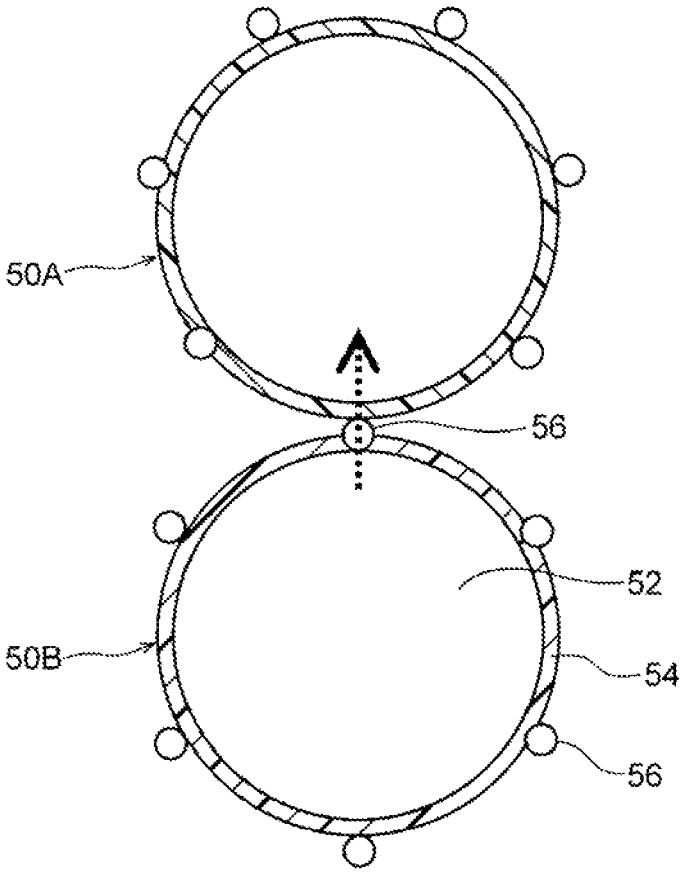
FIG. 1 is a schematic diagram illustrating a state where silica particles are inserted between a carrier and another carrier.

Meanwhile, as illustrated in FIG. 1, if the silica particles 56 flaked from the toner are attached to the surfaces of the magnetic member dispersing type resin coated carriers 50A and 50B first, the silica particles 56 may be embedded in the resin coated layer 54 coating the surface of the core 52 and may be inserted between the carrier 50A and another carrier 50B. Since the magnetic member dispersing type resin coated carriers 50A and 50B have less ruggedness and less undulations (difference in height) on the surface, if the silica particles 56 are inserted between both carriers, an another contact point is hardly formed between the carrier 50A and another carrier 50B, other than the portion where the silica particles 56 are inserted. Therefore, a conductive path formed by the contact between the carrier 50A and the carrier 50B is not formed, which may cause an increase in carrier resistance. Also, if the carrier resistance is increased, the carrier tends to be excessively charged. As a result, when a solid image having high concentration is developed, the toner to be developed at the end of the solid image may be scrapped off electrostatically by a magnetic brush including the excessively charged carrier, and deletion at the end of an image, which is referred to as image defect (STV), may occur.

In contrast, the specific silica particles whose compression aggregation degree and particle compression ratio satisfy the above range are silica particles having high fluidity and dispersivity to the toner particles, and high aggregating properties and adhesion to the toner particles.

Here, since the silica particles generally have satisfactory fluidity but have low bulk density, the silica particles have low adhesion and are hardly aggregated.

Meanwhile, for the purpose of increasing fluidity of the silica particles and dispersivity to the toner particles, a technology, in which the surface of the silica particles is surface treated by using a hydrophobizing agent, is known. According to this technology, fluidity and dispersivity to the toner particles of the silica particles are improved, but cohesive properties are low as it is.

Also, a technology, in which the surface of the silica particles is surface treated by using a hydrophobizing agent and silicone oil in combination, is known. According to this technology, adhesion to the toner particles is improved and cohesive properties are improved as well. However, reversely, fluidity and dispersivity to the toner particles tend to be decreased.

In other words, in the silica particles, it may be said that fluidity and dispersivity to the toner particles, and cohesive properties and adhesion to the toner particles are in an opposite relationship.

In contrast, in the specific silica particles, as described above, if the compression aggregation degree and the particle compression ratio are within the above range, four properties, which are fluidity, dispersivity to the toner particles, cohesive properties, and adhesion to the toner particles become satisfactory.

Next, significance of setting the compression aggregation degree and the particle compression ratio of the specific silica particles within the above range will be described in an order.

First, significance of setting the compression aggregation degree of the specific silica particles from 60% to 95% will be described.

The compression aggregation degree is an index indicating cohesive properties and adhesion to the toner particles of the silica particles. This index indicates a degree in which how difficult the molded article is loosened when the molded article of the silica particles is made to be dropped, after a molded article of the silica particles is obtained by compressing the silica particles.

Accordingly, as the compression aggregation degree is higher, the bulky density of the silica particles is easily increased and a cohesive force (an intermolecular force) tends to be strengthened, and an adhesive force to the toner particles tends to be strengthened. In addition, a method for calculating the compression aggregation degree will be specifically described below.

Therefore, if the compression aggregation degree is from 60% to 95%, the highly controlled specific silica particles have satisfactory adhesion to the toner particles and cohesive properties. The upper limit of compression aggregation degree is 95%, from a viewpoint of securing fluidity and dispersivity to the toner particles, while adhesion to the toner particles and cohesive properties are maintained satisfactorily.

Next, significance of setting the particle compression ratio of the specific silica particles from 0.20 to 0.40 will be described.

The particle compression ratio is an index indicating fluidity of the silica particles. Specifically, the particle compression ratio is indicated by the ratio of a difference between a packed apparent specific gravity and an aerated apparent specific gravity of the silica particles to the packed apparent specific gravity ((packed apparent specific gravity -aerated apparent specific gravity)/packed apparent specific gravity).

Accordingly, as the particle compression ratio is lower, the silica particles have high fluidity. If fluidity is high, dispersivity to the toner particles tends to be increased. In addition, a method for calculating the particle compression ratio will be specifically described below.

Therefore, the specific silica particles whose particle compression ratio is controlled to be low, which is from 0.20 to 0.40, have satisfactory fluidity and dispersivity to the tones particles. However, the lower limit of the particle compression ratio is 0.20, from a viewpoint of improving adhesion to the toner particles and cohesive properties, while fluidity and dispersivity to the toner particles are maintained satisfactorily.

From the above, the specific silica particles have particular properties such as fluidity, dispersivity to the toner particles, a cohesive force, and an adhesive force to the toner particles. Therefore, the specific silica particles whose compression aggregation degree and the particle compression ratio satisfy the above range are the silica particles having high fluidity and dispersivity to the toner particles, and high cohesive properties and adhesion to the toner particles.

Next, a presumable action when the specific silica particles are added to the toner particles will be described.

First, since the specific silica particles have high fluidity and dispersivity to the toner particles, if the specific silica particles are added to the toner particles, the specific silica particles are easily attached to the surface of the toner particles almost uniformly. Since the specific silica particles attached to the toner particles have high adhesion to the toner particles, the specific silica particles are hardly flaked from the toner particles by the mechanical load caused by stirring within the a developing unit. As a result, the silica particles flaked to the magnetic member dispersing type resin coated carrier are less attached and insertion of the silica: particles between the carrier and another carrier is reduced. As a result, an increase in carrier resistance caused by insertion of the silica particles between the carriers is prevented.

In addition, even in a case where the specific silica particles are flaked from the toner particles and attached to the surface of the magnetic member dispersing type resin coated carrier, high cohesive properties are exhibited on the surface of the carrier, and the particles are aggregated easily to be an aggregate. Thus, the particles are easily removed from the surface of the carrier. Therefore, the silica particles attached to the surface of the carrier are hardly kept on the surface of the carrier as it is, and insertion of the silica particles between the carrier and another carrier is reduced. As a result, an increase in carrier resistance caused by insertion of the silica particles between the carriers is prevented.

From the above, it is presumed that the developer according to the exemplary embodiment may prevent occurrence of deletion in an image (image defect).

In the developer according to the exemplary embodiment, the particle dispersion degree of the specific silica particles is preferably from 90% to 100%.

Here, significance of setting the particle dispersion degree of the specific silica particles from 90% to 100% will be described.

The particle dispersion degree is an index indicating dispersivity of the silica particles. This index indicates a degree in which how easy the silica particles in the primary particle state are dispersed to the toner particles. Specifically, when a calculated coverage of the surface of the toner particles by the silica particles is set to $C_0$ and an actually measured coverage is set to C, the particle dispersion degree indicates the ratio (actually measured coverage C/calculated coverage $C_0$) of the calculate coverage $C_0$ to the actually measured coverage C of the attachment target.

Accordingly, as the particle dispersion degree is higher, the silica particles are hardly aggregated on the surface of the toner particles and easily dispersed in the toner particles in a primary particle state. In addition, a method for calculating the particle dispersion degree will be specifically described below.

By controlling the particle dispersion degree to high, which is from 90% to 100%, while the compression aggregation degree and the particle compression ratio are controlled within the above range, the specific silica particles have further satisfactory dispersivity to the toner particles. By doing this, fluidity of the toner particles themselves is increased, and the high fluidity is maintained easily. As a result, further, the specific silica particles are easily attached to the surface of the toner particles almost uniformly and are hardly flaked from the toner particles, and the attachment of the silica particles flaked to the magnetic member dispersing type resin coated carrier is reduced.

In the developer according to the exemplary embodiment, as the specific silica particles having high fluidity and dispersivity to the toner particles and high cohesive properties and adhesion to the toner particles, as described above, silica particles having a siloxane compound with a relatively high weight average molecular weight attached to the surface are preferably exemplified. Specifically, silica particles having the siloxane compound with viscosity from 1,000 cSt to 50,000 cSt attached to the surface (preferably attached in the surface attachment amount from 0.01% by weight to 5% by weight) are preferably exemplified. The specific silica particles are obtained by a method for surface treating the surface of the silica particles using, for example, a siloxane compound whose viscosity is from 1,000 cSt to 50,000 cSt, such that the surface attachment amount is from 0.01% by weight to 5% by weight.

Here, the surface attachment amount is based on the ratio to the silica particles (untreated silica particles) before the surface of the silica particles are surface treated. In below, the silica particles before surface treatment (in other words, untreated silica particles) are simply referred to as "silica particles".

In the specific silica particles in which the surface of the silica particles are surface treated using a siloxane compound whose viscosity is from 1,000 cSt to 50,000 cSt, such that the surface attachment amount is from 0.01% by weight to 5% by weight, fluidity and dispersivity to the toner particles, and cohesive properties and adhesion to the toner particles are increased, and it is easy for the compression aggregation degree and the particle compression ratio to satisfy the above requirement. Also, occurrence of deletion in an image (image defect) is easily prevented. The reason for this is not clear but it is considered that this is because of the following reasons.

If a siloxane compound having a relatively great viscosity, in which the viscosity is within the above range, is attached to the surface of the silica particles in a small amount of the above range, a function derived from the properties of the siloxane compound on the surface of the silica particles is exhibited. The mechanism thereof is not clear, but when the silica particles flow, since the siloxane compound having a relatively great viscosity is attached in a small amount of the above range, releasing properties derived from the siloxane compound are easily exhibited, or adhesion between the silica particles is reduced due to reduction of an interparticle force caused by steric hindrance of the siloxane compound. Due to the above, fluidity and dispersivity to the toner particles of the silica particles are further increased.

Meanwhile, when pressure is applied to the silica particles, long molecular chains of the siloxane compound on the surface of the silica particles are entangled, closely-packing properties of the silica particles are increased, and aggregation between the silica particles is strengthened. In addition, it is considered that the cohesive force of the silica particles caused by entanglement of the long molecular chains of the siloxane compound is loosened if the silica particles are made to flow. In addition to this, the adhesive force to the toner particles is also increased due to the long molecular chains of the siloxane compound on the surface of the silica particles.

From the above, in the specific silica particles in which the siloxane compound having viscosity of the above range is attached to the surface of the silica particles in a small amount of the above range, the compression aggregation degree and the particle compression ratio easily satisfy the above requirement, and the particle dispersion degree also easily satisfies the above requirement.

Hereinafter, the configuration of the developer will be described in detail.

Toner

Toner Particles

The toner particles are configured to include, for example, a binder resin, if necessary, a coloring agent, and a release agent, other additives.

Binder Resin

Examples of the binder resin include a vinyl resin including a homopolymer of a monomer such as styrenes (for example, styrene, parachlorostyrene, α-methyl styrene, or the like), (meth) acrylates (for example, methyl acrylate, ethyl acrylate, n-propyl acrylate, n-butyl acrylate , lauryl acrylate, 2-ethylhexyl acrylate, methyl methacrylate, ethyl methacrylate, n-propyl methacrylate, lauryl methacrylate, 2-ethylhexyl methacrylate, or the like), ethylenically unsaturated nitriles (for example, acrylonitrile, methacrylonitrile, or the like), vinylethers (for example, vinyl methyl ether, vinyl isobutyl ether, or the like), vinyl ketones (vinyl methyl ketone, vinyl ethyl ketone, vinyl isopropenyl ketone, or the like), and olefins (for example, ethylene, propylene, butadiene, or the like); or a copolymer where two or more types of the monomer are combined.

Examples of the binder resin include a nonvinyl resin such as an epoxy resin, a polyester resin, a polyturethane resin, a polyamide resin, a cellulose resin, a polyether resin, and a modified rosin, a mixture of these and the vinyl resin, or a graft polymer obtained by polymerizing the vinyl monomer in the presence of these resins.

The one type of the binder resin may be used alone or two or more types thereof may be used in combination.

A polyester resin is preferable as the binder resin.

Examples of the polyester resin include well-known polyester resins.

Examples of the polyester resin include a polycondensate of polyvalent carboxylic acid and polyol. In addition, a commercially available product may be used or a synthesized resin may be used as the polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, sebacic acid, or the like), alicyclic dicarboxylic acid (for example, cyclohexane dicarboxylic acid, or the like), aromatic dicarboxylic acid (for example, terephthalic acid, isophthalic acid, phthalic acid, naphthalene dicarboxylic acid, or the like), anhydrides thereof, or lower (for example, having 1 to 5 carbon atoms) alkyl ester thereof. Among these, for example, aromatic dicarboxylic acid is preferable as the polyvalent carboxylic acid.

As the polyvalent carboxylic acid, trivalent or higher carboxylic acid having a crosslinking structure or a branched structure may be used in combination with dicarboxylic acid. Examples of the trivalent or higher carboxylic acid include trimellitic acid, pyromellitic acid, anhydrides thereof, or lower (for example, having 1 to 5 carbon atoms) alkyl ester.

The one type of the polyvalent carboxylic acid may be used alone or two or more types thereof may be used in combination.

Examples of the polyol include aliphatic diol (for example, ethylene glycol, diethylene glycol, triethylene glycol, propylene glycol, butanediol, hexanediol, neopentyl glycol, or the like), alicyclic diol (for example, cyclohexane diol, cyclohexane dimethanol, hydrogenated bisphenol A, or the like), aromatic diol (for example, an ethylene oxide adduct of bisphenol A, a propylene oxide adduct of bisphenol A, or the like). Among these, for example, aromatic diol and alicyclic diol are preferable, and aromatic diol is more preferable as the polyol.

As the polyol, trivalent or higher polyol having a crosslinking structure or a branched structure may be used in combination with diol. Examples of the trivalent or higher polyol include glycerin, trimethylolpropane, and pentaerythritol.

The one type of the polyol may be used alone or two or more types thereof may be used in combination.

The glass transition temperature (Tg) of the polyester resin is preferably from 50° C. to 80° C., and more preferably from 50° C. to 65° C.

In addition, the glass transition temperature is obtained by a DSC curve obtained by a differential scanning calorimeter (DSC) and, more specifically, is obtained from an "extrapolation glass transition start temperature" described in the method for obtaining a glass transition temperature of the JISK7121-1987 "method for measuring a plastic transition temperature".

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably 2 to 60.

In addition, the weight average molecular weight and the number average molecular weight are measured by gel permeation chromatography (GPC). The molecular weight measurement by GPC is performed by using GPC.HLC-8120GPC manufactured by TOSHO CORPORATION as a measuring apparatus, Column-TSKGEL SUPER HM-M (15 cm) manufactured by TOSHO CORPORATION, and a THF solvent. The weight average molecular weight and the number average molecular weight are calculated by using a molecular weight calibration curve created by a monodispersed polystyrene standard sample from the measurement result.

The polyester resin is obtained by the well-known preparing method. Specifically, the polyester resin is obtained, for example, by a method in which the polymerization temperature is set to 180° C. to 230° C., and the pressure within a reaction system is decreased if necessary to perform a reaction, while water or alcohol generated at the time of condensation is removed.

In addition, in a case where a raw material monomer is not dissolved or compatible under the reaction temperature, a solvent having a high boiling point may be added as a solubilizing agent to cause the monomer to be dissolved. In this case, a polycondensation reaction is performed while the solubilizing agent is distilled. In a case where a monomer having low compatibility exists, the major component may be polycondensed, after the monomer having low compatibility and acid or alcohol to be polycondensed with this monomer are condensed.

The content of the binder resin is, for example, preferably from 40% by weight to 95% by weight, more preferably from 50% by weight to 90% by weight, and still more preferably from 60% by weight to 85% by weight, with respect to the total toner particles.

Coloring Agent

Examples of the coloring agent include various pigments such as Carbon Black, Chrome Yellow, Hansa Yellow, Benzidine Yellow, Threne Yellow, Quinoione Yellow, Pigment Yellow, Permanent Orange GTR, Pyrazolone Orange, Vulcan Orange, Watch Young Red, Permanent Red, Brilliant Carmine 3B, Brilliant Carmine 6B, Dupont Oil Red, Pyrazolone Red, Lithol Red, Rhodamine B Lake, Lake Red C, Pigment Red, Rose Bengal, Aniline Blue, Ultra Marine Blue, Calco Oil Blue, Methylene Blue Chloride, Phthalocyanine Blue, Pigment Blue, Phthalocyanine Green, and Malachite Green Oxalate; and various dyes such as an acridine dye, a xanthene dye, an azo dye, a benzoquinone dye, an azine dye, an anthraquinone dye, a thioindigo dye, a dioxazine dye, a thiamine dye, an azomethine dye, an indigo dye, a phthalocyanine dye, an aniline black dye, polymethine dye, a triphenylmethane dye, a diphenylmethane dye, and a thiazole dye.

The one type of the coloring agent may be used alone or two or more types thereof may be used in combination.

As the coloring agent, a coloring agent which is surface treated, if necessary, may be used, and the coloring agent may be used in combination with a dispersant. Also, plural types of the coloring agents may be used in combination.

The content of the coloring agent is, for example, preferably from 1% by weight to 30% by weight and more preferably from 3% by weight to 15% by weight, with respect to the total toner particles.

Release Agent

Examples of the release agent include hydrocarbon wax; natural wax such as carnauba wax, rice wax, and candelilla wax; synthesized or mineral-petroleum wax such as montan wax; an ester wax such as fatty acid ester and montanic acid ester. The release agent is not limited to these.

The melting temperature of the release agent is preferably from 50° C. to 110° C. and more preferably from 60° C. to 100° C.

In addition, the melting temperature is obtained from an "melting peak temperature" described in the method for obtaining a melting temperature of the JISK7121-1987

"method for measuring a plastic transition temperature", from the DSC curve obtained by the differential scanning calorimeter (DSC).

The content of the release agent is, for example, preferably from 1% by weight to 20% by weight and more preferably from 5% by weight to 15% by weight, with respect to the total toner particles.

Other Additives

Examples of the other additives include the well-known additives such as a magnetic member, a charge-controlling agent, and an inorganic powder. These additives are included in the toner particles as an internal additive.

Properties of Toner Particles

The toner particles may be toner particles having a single-layer structure, and toner particles having a so-called core-shell structure configured by a core (core particles) and a coating layer (a shell layer) coating the core.

Here, the toner particles having a core-shell structure may be configured to include, for example, a core including other additives such as a binder resin, if necessary, a coloring agent, and a release agent and a coating layer including a binder resin.

The volume average particle diameter (DS0v) of the toner particles is preferably from 2 μm to 10 μm and more preferably from 4 μm to 8 μm.

In addition, various average particle diameters, and various particle diameter distribution indices of the toner particles are measured by using a COULTER MULTISIZER II (manufactured by Beckman Coulter, Inc.) and ISOTON-II (manufactured by Beckman Coulter, Inc.) as an electrolyte.

At the time of measuring, a 0.5 mg to 50 mg of measurement sample is added to a 2 ml of 5% aqueous solution of a surfactant (sodium alkyl benzene sulfonate is preferable) as a dispersant. This is added to a 100 ml to 150 ml of electrolyte.

An electrolyte in which the sample is suspended is dispersed by an ultrasonic disperser for 1 minute, and particle diameter distribution of the particles having a particle diameter in a range from 2 μm to 60 μm is measured using an aperture with an aperture diameter of 100 μm, by a coulter multisizer II. Also, the number of particles for sampling is 50,000.

The cumulative distributions of the volume and the number are respectively drawn from a small diameter side with respect to the divided particle diameter range (channel) based on the measured particle diameter distribution. The particle diameter as cumulative 16% is defined as a volume particle diameter D16v and a number particle diameter D16p, the particle diameter as cumulative 50% is defined as a volume average particle diameter D50v and an cumulative number average particle diameter D50p, and the particle diameter as cumulative 84% is defined as a volume particle diameter D84v and a number particle diameter D84p.

By using these, the volume average particle diameter distribution index (GSDv) is calculated as $(D84v/D16v)^{1/2}$, the number average particle diameter distribution index (GSDp) is calculated as $(D84p/D16p)^{1/2}$.

The shape factor SF1 of the toner particles is preferably from 110 to 150 and more preferably front 120 to 140.

In addition, the shape factor SF1 is obtained according to the following equation.

$$SF1=(ML^2/A)\times(\pi/4)\times 100$$

In the equation, ML represents an absolute maximum length of the toner, and A represents a projected area of the toner, respectively.

Specifically, the shape factor SF1 is digitized by analyzing at microscope image or a SEM (Scanning Electron Microscope) image using an image analyzer, and calculated as follows. In other words, the shape factor SF1 is obtained as follows: an optical microscope image of the particles distributed on a slide glass surface is taken in the Luzex image analyzer using a video camera; the maximum length and the projected area of the 100 particles are obtained and calculated according to the above equation; and the average value thereof are obtained.

External Additive

The external additive in the toner includes the specific silica particles. The external additive may include other external additives other than the specific silica particles. In other words, only the specific silica particles are added to the toner particles or other external additives and the specific silica particles may be added to the toner particles.

Specific Silica Particles

Compression Aggregation Degree

The compression aggregation degree of the specific silica particles is from 60% to 95%, but the compression aggregation degree is preferably from 70% to 95% and more preferably from 80% to 95%, from a viewpoint of securing fluidity and dispersivity to the toner particles (in particular, from a viewpoint of preventing occurrence of deletion in an image (image defect)), while cohesive properties and adhesion to the toner particles are maintained satisfactorily in the specific silica particles.

The compression aggregation degree is calculated by the method shown below.

A disk-shaped mold having a diameter of 6 cm is filled with 6.0 g of the specific silica particles. Next, the mold is compressed under a pressure of 5.0 t/cm$^2$ for 60 seconds using a compression molding machine (manufactured by Maekawa Testing Machine MFG. Co., LTD.) to obtain a compressed disk-shaped molded article of the specific silica particles (hereinafter, referred to as a "molded article before dropping"). After that, the weight of the molded article before dropping is measured.

Subsequently, the molded article before dropping is disposed on a sieve having an aperture of 600 μm, and the molded article before dropping is made to drop under vibration amplitude of 1 mm and vibration time of 1 minute by a vibration sieving machine (manufactured by TSUTSUI SCIENTIFIC INSTRUMENTS CO., LTD.: Product No. VIBRATING MVB-1). By doing this, the specific silica particles are dropped from the molded article before dropping via the sieving screen, a molded article of the specific silica particles remains on the sieving screen. After that, the weight of the molded article of the remaining specific silica particles (hereinafter, referred to as a "molded article after dropping") is measured.

Then, the compression aggregation degree is calculated from the ratio of the weight of the molded article after dropping to the weight of the molded article before dropping using the following Equation (1).

$$\text{Compression aggregation degree}=(\text{weight of the molded article after dropping}/\text{weight of the molded article before dropping})\times 100 \quad \text{Equation (1)}$$

Particle Compression Ratio

The particle compression ratio of the specific silica particles is from 0.20 to 0.40, but the particle compression ratio is preferably from 0.24 to 0.38 and more preferably 0.28 to 0.36, from a viewpoint of securing fluidity and dispersivity to the toner particles (in particular, from a viewpoint of preventing occurrence of deletion in an image (image defect)), while cohesive properties and adhesion to the toner particles are maintained satisfactorily in the specific silica particles.

The particle compression ratio is calculated by the method shown below.

The aerated apparent specific gravity and packed apparent specific gravity of the silica particles are measured by using a powder tester (manufactured by Hosokawa Micro Group., Product No. PT-S type). Then, the particle compression ratio is calculated from the ratio of the difference between the packed apparent specific gravity and the aerated apparent specific gravity of the silica particles to the packed apparent specific gravity using the following Equation (2).

Particle compression ratio=(packed apparent specific gravity−aerated apparent specific gravity)/packed apparent specific gravity Equation (2)

In addition, the "aerated apparent specific gravity" is a measured value obtained by filling a container with a capacity of 100 $cm^3$ with the silica particles and weighing the particles, and refers to a filling specific gravity in a state where the specific silica particles are made to naturally fall in the container. The "packed apparent specific gravity" refers to an apparent specific gravity in which the container is deaerated from the aerated apparent specific gravity state, by repetitively imparting shock (tapping) to the bottom of the container 180 times, at a slide stroke of 18 mm and a tapping speed of 50 times/min, and the specific silica particles are rearranged and fill the container more densely.

Particle Dispersion Degree

The particle dispersion degree of the specific silica particles is preferably from 90% to 100%, more preferably from 95% to 100% and still more preferably 100%, from a viewpoint of obtaining more satisfactory dispersivity to the toner particles (in particular, from a viewpoint of preventing occurrence of deletion in an image (image defect).

The particle dispersion degree is the ratio of the actually measured coverage C to the toner particles to the calculated coverage $C_0$ and calculated by the following Equation (3).

Particle dispersion degree=actually measured coverage C/calculated coverage $C_0$ Equation (3)

Here, when the volume average particle diameter of the toner particles is set to dt (m), the average equivalent circle diameter of the specific silica particles is set to da (m), the specific gravity of the toner particles is set to ρt, the specific gravity of the specific silica particles is set to ρa, the weight of the toner particles is set to Wt (kg), and the addition amount of the specific silica particles is set to Wa (kg), the calculated coverage $C_0$ to the surface of the toner particles using the specific silica particles may be calculated by the following Equation (3-1).

$$\text{Calculated coverage } C_0=\sqrt{3}/(2\pi)\times(\rho t/\rho a)\times(dt/da)\times(Wa/Wt)\times 100\ (\%) \quad \text{Equation (3-1)}$$

A signal intensity of a silicon atom derived from the specific silica particles is measured respectively, with respect to the only toner particles, the only specific silica particles, and the toner particles coated (attached) with the specific silica particles using XPS (X-ray Photoelectron Spectroscopy) ("JPS-9000 MX": manufactured by JOEL Ltd.), and the results are calculated by the following Equation (3-2) to obtain the actually measured coverage C to the surface of the toner particles using the specific silica particles.

$$\text{Actually measured coverage } C=(z-x)/(y-x)\times 100\ (\%) \quad \text{Equation (3-2)}$$

(In Equation (3-2), x represents a signal intensity of a silicon atom derived from specific silica particles of the only toner particles. y represents a signal intensity of a silicon atom derived from specific silica particles of the only specific silica particles. z represents a signal intensity of a silicon atom derived from specific silica particles of the toner particles coated (attached) with the specific silica particles.

Average Equivalent Circle Diameter

The average equivalent circle diameter of the specific silica particles is preferably from 40 nm to 200 nm, more preferably from 50 nm to 180 nm, and still more preferably from 60 nm to 160 nm, from a viewpoint of obtaining satisfactory fluidity, dispersivity to the toner particles, cohesive properties, and adhesion to the toner particles of the specific silica particles (in particular, from a viewpoint of preventing occurrence of deletion in an image (image defect)).

The average equivalent circle diameter D50 of the specific silica particles is obtained as follows; primary particles after the specific silica particles are added to the toner particles are observed by SEM (Scanning Electron Microscope) (manufactured by Hitachi, Ltd.: S-4100) to capture an image; the image is taken in the image analyser (LUZEXIII, manufactured by NIRECO.); the area of each particle is measured by image analysis of the primary particles; the equivalent circle diameter of the specific silica particles is calculated from this area value; and 50% diameter (D50) in the cumulative frequency of the volume basis or the obtained equivalent circle diameter is regarded as the average equivalent circle diameter D50 of the specific silica particles. In addition, the magnification of the electron microscope is adjusted such that from about 10 to 50 of the specific silica particles are captured within one view, and the equivalent circle diameter of the primary particles is obtained by combining the view with plural views observed.

Average Circularity

The shape of the specific silica particles may be either spherical or variant, but the average circularity of the specific silica particles is preferably from 0.85 to 0.98, more preferably from 0.90 to 0.98, and still more preferably from 0.93 to 0.98, from a viewpoint of obtaining satisfactory fluidity, dispersivity to the toner particles, cohesive properties, and adhesion to the toner particles in the specific silica particles (in particular, from a viewpoint of preventing occurrence of deletion in an linage (image defect)).

The average circularity of the specific silica particles is measured by the method shown below.

First, the circularity of the specific silica particles are obtained as follows: primary particles after the silica particles are added to the toner particles are observed by a SEM; and the circularity is obtained as "100/SF2" calculated from the following equation from the obtained plane image analysis of the primary particles.

$$\text{Circularity } (100/SF2)=4\pi\times(A/I^2)$$

[In the equation, I represents a circumference length of the primary particles on the image, and A represents a projected area of the primary particles.]

In addition, the average circularity of the specific silica particles is obtained as 50% circularity in the cumulative frequency of the circularity of 100 primary particles obtained from the plane image analysis.

Here, a method for measuring respective properties (compression aggregation degree, particle compression ratio, particle dispersion degree, and average circularity) of the specific silica particles from the toner will be described.

First, the external additive (specific silica particles) is separated from the toner as follows. After the toner is put into methanol, dispersed, and stirred, by treating the toner in an ultrasonic bath, it is possible to separate the external additive from the toner. The particle diameter and specific gravity of the external additive determine easiness of separating the external additive from the toner, and the specific silica particles may be separated by adjusting the condition of the ultrasonic treatment. The toner particles are precipitated by centrifugation the resultant to collect only methanol having the external additive dispersed therein. After that, the specific silica particles may be extracted by volatilizing the methanol. Also, the respective properties are measured by using the separated specific silica particles.

Hereinafter, the configuration of the specific silica particles will be described in detail.

Specific Silica Particles

The specific silica particles are particles including silica (in other words, $SiO_2$) as a major component, and the particles may be crystalline or amorphous. The specific silica particles may be particles prepared by using a silicon compound such as water glass and alkoxysilane as a raw material, or particles obtained by pulverizing quartz.

Specific examples of the specific silica particles include silica particles (hereinafter, "sol gel silica particles") prepared by a sol gel method, aqueous colloidal silica particles, alcoholic silica particles, fumed silica particles obtained by a gas phase method, and molten silica particles, and among these, the sol gel silica particles are preferable.

Surface Treatment

In order to cause the compression aggregation degree, the particle compression ratio, and the particle dispersion degree to be within the above specific range, the specific silica particles are preferably surface treated with a siloxane compound.

As the surface treatment method, the surface of the silica particles are preferably surface treated in supercritical carbon dioxide, by using supercritical carbon dioxide. In addition, the surface treatment method will be described below.

Siloxane Compound

The siloxane compound is not particularly limited as long as a compound has a siloxane skeleton in a molecular structure.

Examples of the siloxane compound include silicone oil and a silicone resin. Among these, silicone oil is preferable, from a viewpoint of surface treating the surface of the silica particles in an almost uniform state.

Examples of the silicone oil include a dimethyl silicone oil, a methyl hydrogen silicone oil, a methyl phenyl silicone oil, an amino modified silicone oil, an epoxy modified silicone oil, a carboxyl modified silicone oil, a carbinol modified silicone oil, a methacryl modified silicone oil, a mercapto modified silicone oil, a phenol modified silicone oil, a polyether modified silicone oil, a methylstyryl modified silicone oil, an alkyl modified silicone oil, a higher fatty acid ester modified silicone oil, a higher fatty acid amide modified silicone oil, and a fluorine modified silicone oil. Among these, a dimethyl silicone oil, a methyl hydrogen silicone oil, and an amino modified silicone oil are preferable.

The one type of the siloxane compound may be used alone or two or more types thereof may be used in combination.

Viscosity

The viscosity (kinetic viscosity) of the siloxane compound is preferably from 1,000 cSt. to 50,000 cSt, more preferably from 2,000 cSt to 30,000 cSt, and still more preferably from 3,000 cSt to 10,000 cSt, from a viewpoint of obtaining satisfactory fluidity, dispersivity to the toner particles, cohesive properties, and adhesion to the toner particles in the specific silica particles (in particular, from a viewpoint of preventing occurrence of deletion in an image (image defect)).

The viscosity of the siloxane compound is obtained in the following order. Toluene is added to the specific silica particles and dispersed by an ultrasonic disperser for 30 minutes. After that, a supernatant is collected. At this time, a toluene solution of the siloxane compound having concentration of 1 g/100 ml is obtained. The specific viscosity $[\eta_{sp}]$ (25° C.) at this time is obtained by the following Equation (A).

$$\eta_{sp}=(\eta/\eta_0)-1 \quad (\eta_0\text{: viscosity of toluene, } \eta\text{: viscosity of the solution}) \qquad \text{Equation (A)}$$

Next, the specific viscosity $[\eta_{sp}]$ is substituted into Huggins relational expression shown as the following Equation (B) to obtain intrinsic viscosity $[\eta]$.

$$\eta_{sp}=[\eta]+K'[\eta]^2 \quad (K'\text{: an integer of Huggins } K'=0.3 \text{ (at the time when } [\eta]=1 \text{ to } 3)) \qquad \text{Equation (B)}$$

Next, the intrinsic viscosity $[\eta]$ is substituted into A. Kolorlov equation shown as the following Equation (C) to obtain a molecular weight M.

$$[\eta]=0.215\times10^{-4}M^{0.65} \qquad \text{Equation (C)}$$

The molecular weight M is substituted into A. J. Barry equation shown as the following Equation (D) to obtain siloxane viscosity $[\eta]$.

$$\log\eta=1.00+0.0123M^{0.5} \qquad \text{Equation (D)}$$

Surface Attachment Amount

The surface attachment amount of the siloxane compound to the surface of the specific silica particles is preferably from 0.01% by weight to 5% by weight, more preferably from 0.05% by weight to 3% by weight, and still more preferably from 0.10% by weight to 2% by weight, with respect to the silica particles (the silica particles before the surface treatment), from a viewpoint of obtaining satisfactory fluidity, dispersivity to the toner particles, cohesive properties, and adhesion to the toner particles in the specific silica particles (in particular, from a viewpoint of preventing occurrence of deletion in an image (image defect)).

The surface attachment amount is measured by the method shown below.

After 100 mg of the specific silica particles are dispersed in 1 mL of chloroform, and 1 μL of DMF (N,N-dimethyl formamide) is added thereto as an internal standard fluid, the resultant is ultrasonically treated by an ultrasonic cleaner for 30 minutes to extract a siloxane compound to a chloroform solvent. After that, hydrogen nuclear spectroscopy is measured by the JNM-AL400 type nuclear magnetic resonance (manufactured by JEOL Ltd.), the amount of the siloxane compound is obtained from the ratio of the peak area derived from the siloxane compound to the peak area derived from DMF. In addition, the surface attachment amount is obtained from the amount of the siloxane compound.

Here, the specific silica particles is surface treated with the siloxane compound having viscosity of 1,000 cSt to 50,000 cSt, and the surface attachment amount of the siloxane compound to the surface of the silica particles is preferably from 0.01% by weight to 5% by weight.

By satisfying the above requirement, it is easy to obtain the specific silica particles having satisfactory fluidity and dispersivity to the toner particles, and improved cohesive properties and adhesion to the toner particles.

External Addition Amount

The external addition amount of the specific silica particles (content) is preferably from 0.1% by weight to 6.0% by weight, more preferably from 0.3% by weight to 4.0% by weight, and still more preferably from 0.5% by weight to 2.5% by weight, with respect to the toner particles, from a viewpoint of preventing occurrence of deletion in an image (image defect).

Method for Preparing Specific Silica Particles

The specific silica particles are obtained by surface treating the surface of the silica particles by the siloxane compound having viscosity of 1,000 cSt to 50,000 cSt, such that the surface attachment amount is from 0.01% by weight to 5% by weight with respect to the silica particles.

According to the method for preparing the specific silica particles, it is possible to obtain silica particles having satisfactory fluidity and dispersivity to the toner particles and improved cohesive properties and adhesion to the toner particles.

Examples of the surface treatment method include a method for surface treating the surface of the silica particles by the siloxane compound in supercritical carbon dioxide; and a method for surface treating the surface of the silica particles by the siloxane compound in the air.

Specific examples of the surface treatment method include a method for dissolving the siloxane compound in super critical carbon dioxide using supercritical carbon dioxide to attach the siloxane compound to the surface of the silica particles; a method for imparting a solution including the siloxane compound and a solvent for dissolving the siloxane compound to the surface of the silica particles (for example, spray or coating) to attach the siloxane compound to the surface of the silica particles in the air; and a method in which after a solution including the siloxane compound and a solvent for dissolving the siloxane compound is added to a silica particle dispersion and kept in the air, a mixed solution of the silica particle dispersion and the solution is dried.

Among these, as the surface treatment method, a method for attaching the siloxane compound to the surface of the silica particles using supercritical carbon dioxide is preferable.

If the surface treatment is performed in supercritical carbon dioxide, the siloxane compound in supercritical carbon dioxide becomes a dissolved state. Since the supercritical carbon dioxide has properties of having low interfacial tension, it is considered that the siloxane compound in a dissolved state in supercritical carbon dioxide and the supercritical carbon dioxide are diffused to easily reach deep in the pores of the surface of the silica particles, so that the surface treatment is performed not only to the surface of the silica particles but also to the deep down of the pores by the siloxane compound.

Thus, it is considered that the silica particles having surface treated with the siloxane compound in supercritical carbon dioxide become silica particles whose surface is treated to be an almost uniform state by the siloxane compound (for example, the surface treated layer is formed in a thin film shape).

In addition, in the method for preparing the specific silica particles, the surface treatment for imparting hydrophobicity to the surface of the silica particles may be performed by using a hydrophobizing agent with the siloxane compound in supercritical carbon dioxide.

In this case, the hydrophobizing agent is in a dissolved state in supercritical carbon dioxide with the siloxane compound, it is considered that the hydrophobizing agent and the siloxane compound in a dissolved state in supercritical carbon dioxide are diffused to easily reach deep in the pores of the surface of the silica particles with the supercritical carbon dioxide, so that the surface treatment is performed not only to the surface of the silica particles but also to the deep down of the pores by the siloxane compound and the hydrophobizing agent.

As a result, in the silica particles having surface treated with the siloxane compound and the hydrophobizing agent in supercritical carbon dioxide, the surface thereof is treated to be an almost uniform state by the siloxane compound and the hydrophobizing agent and high hydrophobicity is easily imparted.

In addition, in the method for preparing the specific silica particles, supercritical carbon dioxide may be used in other preparing steps of the silica particles (for example, a solvent removing step, or the like).

In other preparing steps, examples of the method for preparing the specific silica particles using supercritical carbon dioxide include a method for preparing the silica particles including a step of preparing a silica particle dispersion containing the silica particles and a solvent including alcohol and water by a sol gel method (hereinafter, refered to as a "dispersion preparing step); a step of removing the solvent from the silica particle dispersion causing supercritical carbon dioxide to flow (hereinafter, referred to as a "solvent removing step"); and a step of surface treating the surface of the silica particles by the siloxane compound after removing the solvent, in supercritical carbon dioxide (hereinafter, referred to as a "surface treatment step").

If a removal of the solvent from the silica particle dispersion is performed by using supercritical carbon dioxide, it is easy to prevent occurrence of a coarse powder.

Although the reason is not clear, the reason is considered as follows: 1) in a case where the solvent of the silica particle dispersion is removed, the solvent may be removed without the particles aggregating to each other by a liquid bridge force at the time of removing the solvent, because of the properties of supercritical carbon dioxide, which is that "interfacial tension does not work"; and 2) because of the properties of supercritical carbon dioxide, which is that "supercritical carbon dioxide is carbon dioxide in a state under the temperature-pressure of the critical point or higher, and has both diffusibility of a gas and solubility of a liquid", the solvent is dissolved by causing the solvent to contact with the supercritical carbon dioxide effectively at a relatively low temperature (for example, 250° C. or lower), the supercritical carbon dioxide having the solvent dissolved is removed, and accordingly, the solvent in the silica particle dispersion may be removed without forming a coarse powder such as a secondary aggregate due to condensation of a silanol group.

Here, the solvent removing step and the surface treatment step may be performed separately, but are preferably performed sequentially (in other words, each step is executed in a non-open state to atmospheric pressure). If each step is performed sequentially, after the solvent removing step, an opportunity of the silica particles to adsorb moisture is lost, and the surface treatment step is performed in a state where adsorption of excessive moisture to the silica particles is prevented. Due to this, it not necessary to use the large amount of the siloxane compound or perform the solvent removing step and the surface treatment step at high temperature by excessively heating. As a result, it is easy to prevent occurrence of a coarse ponder more effectively.

Hereinafter, details of the method for preparing the specific silica particles will be described for each step.

In addition, the method for preparing the specific silica particles is not limited to this and for example, may have 1) an aspect of using supercritical carbon dioxide only in the surface treatment step, or 2) an aspect of separately performing each step.

Hereinafter, each step will be described in detail.

Dispersion Preparing Step

In the dispersion preparing step, for example, a silica particle dispersion containing the silica particles and the solvent including alcohol and water is prepared.

Specifically, in the dispersion preparing step, the silica particle dispersion is prepared by for example, a wet method (for example, a sol gel method, or the like), and this dispersion is prepared. In particular, the silica particle dispersion may be prepared by a sol gel method, as a wet method, and specifically, it is preferable to prepare the silica particle dispersion by reacting tetraalkoxysilane (hydrolysis reaction, condensation reaction) in the solvent including alcohol and water in the presence of an alkali catalyst to form silica particles.

In addition, a preferable range of the average equivalent circle diameter and a preferable range of the average circularity of the silica particles are as described above.

In the dispersion preparing step, for example, in a case where the silica particles are obtained by a wet method, the silica particles are obtained in a state of dispersion where the silica particles are dispersed in the solvent (silica particle dispersion).

Here, when moving to the solvent removing step, in the prepared silica particle dispersion, the weight ratio of water to alcohol may be, for example, from 0.05 to 1.0, and is preferably from 0.07 to 0.5 and more preferably from 0.1 to 0.3.

In the silica particle dispersion, if the weight ratio of water to alcohol is within the above range, occurrence of a coarse powder of the silica particles after the surface treatment is less, and the silica particles having satisfactory electric resistance may be obtained easily.

If the weight ratio of water to alcohol is below 0.05, in the solvent removing step, since a silanol group on the surface of the silica particles when removing the solvent is less condensed, moisture adsorbed to the surface of the silica particles after removing the solvent becomes greater. Accordingly, electric resistance of the silica particles after the surface treatment may be excessively decreased. In addition, if the weight ratio of water exceeds 1.0, in the solvent removing step, a great amount of water may remain in the vicinity of the finishing point of the removal of the solvent in the silica particle dispersion, and the silica particles may be easily aggregated with each other by a liquid bridge force, which may be present as a coarse powder after the surface treatment.

In addition, when moving to the solvent removing step, in the prepared silica particle dispersion, the weight ratio of water to the silica particles may be, for example, from 0.02 to 3, and is preferably from 0.05 to 1 and more preferably 0.1 to 0.5.

In the silica particle dispersion, if the weight ratio of water to silica particles is within the above range, occurrence of a coarse powder of the silica particles is less, and the silica particles having satisfactory electric resistance may be obtained easily.

If the weight ratio of water to silica particles is below 0.02, in the solvent removing step, since a silanol group on the surface of the silica particles when removing the solvent is extremely less condensed, moisture adsorbed to the surface of the silica particles after removing the solvent becomes greater. Accordingly, electric resistance of the silica particles may be excessively decreased.

In addition, if the weight ratio of water exceeds 3, in the solvent removing step, a great amount of water may remain in the vicinity of the finishing point of the removal of the solvent in the silica particle dispersion, and the silica particles may be easily aggregated with each other by a liquid bridge force.

In addition, when moving to the solvent removing step, in the prepared silica particle dispersion, the weight ratio of silica particles to the silica particle dispersion may be, for example, from 0.05 to 0.7, and is preferably from 0.02 to 0.65 and more preferably 0.3 to 0.6.

If the weight ratio of silica particles to the silica particle dispersion is below 0.05, in the solvent removing step, the amount of supercritical carbon dioxide to be used becomes greater, and productivity may be degraded.

In addition, if the weight ratio of silica particles to the silica particle dispersion exceeds 0.7, the distance between the silica particles in the silica particle dispersion may become closer, and a coarse powder may be easily formed due to aggregation or gelation of the silica particles.

Solvent Removing Step

The solvent removing step is a step for removing the solvent of the silica particle dispersion by for example, erasing supercritical carbon dioxide to flow.

In other words, in the solvent removing step, supercritical carbon dioxide is caused to flow, and the supercritical carbon dioxide is caused to contact with the silica particle dispersion to remove the solvent.

Specifically, in the solvent removing step, for example, the silica particle dispersion is put into a hermetically sealed reactor. After that, liquefied carbon dioxide is added to the hermetically sealed reactor and heated, and the pressure within the reactor is increased by a high pressure pump to cause carbon dioxide to be in a supercritical state. In addition, the supercritical carbon dioxide is introduced into the hermetically sealed reactor, discharged, and made to flow within the hermetically sealed reactor, that is, the silica particle dispersion.

Due to this, the supercritical carbon dioxide dissolves the solvent (alcohol and water), which leads the solvent to be discharged to the outside of the silica particle dispersion (outside of the hermetically sealed reactor), and the solvent is removed.

Here, the supercritical carbon dioxide is carbon dioxide in a state under the temperature pressure of the critical point or higher, and has both diffusibility of a gas and solubility of a liquid.

The temperature condition for removing the solvent, in other words, the temperature of supercritical carbon dioxide may be, for example, from 31° C. to 350° C., and is preferably from 60° C. to 300° C. and more preferably from 80° C. to 250° C.

If this temperature is less than the above range, since it is difficult for the solvent to be dissolved in supercritical carbon dioxide, the removal of the solvent may be difficult. In addition, it is considered that a coarse powder may be easily forced by a liquid bridge force of the solvent or supercritical carbon dioxide. Meanwhile, if this temperature exceeds the above range, it is considered that a coarse powder such as a secondary aggregate is easily formed by condensation of the silanol group of the surface of the silica particles.

The pressure condition for removing the solvent, in other words, the pressure of supercritical carbon dioxide may be, for example, from 7.38 MPa to 40 MPa, and is preferably from 10 MPa to 35 MPa and more preferably from 15 MPa to 25 MPa.

If this pressure is less than the above range, there is a tendency that it is difficult for the solvent to be dissolved in supercritical carbon dioxide, and meanwhile, if this pressure exceeds the above range, the cost of facility tends to be high.

In addition, the introduction discharge amount of the supercritical carbon dioxide to the hermetically sealed reactor may be, for example, from 15.4 L/min/$m^3$ to 1,540 L/min/$m^3$, and is preferably from 77 L/min/$m^3$ to 770 L/min/$m^3$.

If this introduction discharge amount is less than 15.4 L/min/$m^3$, since it takes time to remove the solvent, productivity tends to be degraded.

Meanwhile, if this introduction discharge amount is 1,540 L/min/$m^3$ or more, supercritical carbon dioxide short-passes, a contact time with the silica particle dispersion becomes short, and there is a tendency that it is difficult to remove the solvent effectively.

Surface Treatment Step

The surface treatment step is, for example, a step for surface treating the surface of the silica particles by the siloxane compound in supercritical carbon dioxide, continued from the solvent removing step.

In other words, in the surface treatment step, for example, before moving from the solvent removing step, the surface of the silica particles is surface treated with the siloxane compound in supercritical carbon dioxide, without being open to the air.

Specifically, in the surface treatment step, for example, after introduction discharging of supercritical carbon dioxide to the hermetically sealed reactor is stopped in the solvent removing step, the pressure and temperature within the hermetically sealed reactor are adjusted, and the siloxane compound having a predetermined ratio with respect to the silica particles are put into the hermetically sealed reactor, in a state where supercritical carbon dioxide is present. Then, the siloxane compound is reacted in the state where the above state is maintained, in other words, in supercritical carbon dioxide to perform surface treatment of the silica particles.

Here, in the surface treatment step, the reaction of the siloxane compound may be performed in supercritical carbon dioxide (in other words, under the atmosphere of supercritical carbon dioxide), the surface treatment may be performed, while supercritical carbon dioxide is made to flow (in other words, supercritical carbon dioxide is made to introduce discharge to the hermetically sealed reactor), or the surface treatment may be performed, while supercritical carbon dioxide is not made to flow.

In the surface treatment step, the amount, (input amount) of the silica particles with respect to the capacity of the reactor may be, for example, from 30 g/L to 600 g/L, and is preferably from 50 g/L to 500 g/L and more preferably from 80 g/L to 400 g/L.

If this amount is smaller than the above range, the concentration of the siloxane compound with respect to supercritical carbon dioxide may be decreased, a contact probability with the silica surface may be decreased, and the reaction may be difficult to proceed. Meanwhile, if this amount is greater than the above range, the concentration of the siloxane compound with respect to supercritical carbon dioxide may be increased, the siloxane compound may be not dissolved completely in supercritical carbon dioxide, which is a dispersion failure, and a coarse aggregate may be easily formed.

The density of supercritical carbon dioxide may be, for example, from 0.10 g/ml to 0.80 g/ml, and is preferably from 0.10 g/ml to 0.60 g/ml and more preferably from 0.2 g/ml to 0.50 g/ml.

If this density is lower than the above range, there is a tendency that solubility of the siloxane compound with respect to supercritical carbon dioxide is decreased, and an aggregate is formed. Meanwhile, if this density is higher than the above range, since diffusibility to the silica pore is decreased, the surface treatment may be insufficient. In particular, the surface treatment may be performed within the above density range, with respect to sol gel silica particles containing many silanol groups.

In addition, the density of supercritical carbon dioxide is adjusted by temperature and pressure.

Specific examples of the siloxane compound are as described above. In addition, the preferable range of the viscosity of the siloxane compound is as described above.

Among the siloxane compounds, if silicone oil is applied, a silicon oil is easily attached to the surface of the silica particles in an almost uniform state, and fluidity, dispersivity, and handling properties of the silica particles are easily improved.

The use amount of the siloxane compound may be, for example, from 0.05% by weight to 3% by weight, and is preferably from 0.1% by weight to 2% by weight, and more preferably from 0.15% by weight to 1.5% by weight with respect to the silica particles, from a viewpoint of easily controlling the surface attachment amount to the silica particles from 0.01% by weight to 5% by weight.

In addition, the siloxane compound may be used alone, but may be used as a solution mixed with a solvent in which the siloxane compound easily dissolves. Examples of the solvent include toluene, methyl ethyl ketone, and methyl isobutyl ketone.

In the surface treatment step, the surface treatment of the silica particles may be performed by a mixture including a hydrophobizing agent with the siloxane compound.

Examples of the hydrophobizing agent include a silane hydrophobizing agent. Examples of the silane hydrophobizing agent include the well-known silicon compound having an alkyl group (for example, a methyl group, an ethyl group, a propyl group, a butyl group, or the like), and specific examples thereof include a silazane compound (for example, a silane compound such as methyl trimethoxysilane, dimethyl dimethoxysilane, trimethyl chlorosilane, and trimethyl methoxysilane, hexamethyl disilazane, tetaramethyl disilazane, or the like). The one type of the hydrophobizing agent may be used alone or plural types thereof may be used.

Among the silane hydrophobizing agent, a silicon compound having a trimethyl group such as trimethyl methoxysilane and hexamethyl disilazane (HMDS), in particular, hexamethyl disilazane (HMDS) is preferable.

The use amount of the silane hydrophobizing agent is not particularly limited. The use amount thereof may be, for example, from 1% by weight to 100% by weight, and is preferably from 3% by weight to 80% by weight and more preferably from 5% by weight to 50% by weight with respect to the silica particles.

In addition, the silane hydrophobizing agent may be used alone, but may be used as a solution mixed with a solvent in which the silane hydrophobizing agent easily dissolves. Examples of the solvent include toluene, methyl ethyl ketone, and methyl isobutyl ketone.

The temperature condition of the surface treatment, in other words, the temperature of supercritical carbon dioxide may be, for example, from 80° C. to 300° C., and is preferably from 100° C. to 250° C. and more preferably from 120° C. to 200° C.

If this temperature is less than the above range, the surface treatment ability by the siloxane compound may be degraded. Meanwhile, if this temperature exceeds the above ranges a condensation reaction proceeds between the silanol groups of the silica particles, and particle aggregation may occur. In particular, with respect to the sol gel silica particles containing many silanol groups, the surface treatment may be performed within the above range.

Meanwhile, the pressure condition of the surface treatment, in other words, the pressure of the supercritical carbon dioxide may be a condition satisfying the density. However, the pressure thereof may be, for example, from 8 MPa to 30 MPa and is preferably from 10 MPa to 25 MPa and more preferably from 15 MPa to 20 MPa.

Via the respective steps stated above, the specific silica particles are obtained.

Other External Additives

Examples of the other external additives include inorganic particles. Examples of the inorganic particles include $SiO_2$ (however, excluding the specific silica particles), $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_1$, and $MgSO_1$.

The surface of the inorganic particles as the other external additives may be subjected to a hydrophobization treatment. The hydrophobization treatment is performed, for example, by dipping the inorganic particles in the hydrophobizing agent. The hydrophobizing agent is not particularly limited, but examples thereof include a silane coupling agent, a silicone oil, a titanate coupling agent, and an aluminium coupling agent. These may be used alone or two or more types thereof may be used in combination.

The amount of the hydrophobizing agent is normally, for example, from 1 part by weight to 10 parts by weight with respect to 100 parts by weight of the inorganic particles.

Examples of other external additive include resin particles (resin particles of polystyrene, polymethyl methacrylate (PMMA), and a melamine resin), a cleaning aid (for example, a metal salt of higher fatty acid represented by zinc stearate and particles of a fluorine polymer).

The external addition amount of the other external additives is, for example, preferably from 0.1% by weight to 4.0% by weight and more preferably from 0.3% by weight to 2.0% by weight with respect to the toner particles.

Method for Preparing Toner

Next, the method for preparing a toner used in the exemplary embodiment will be described.

The toner used in the exemplary embodiment is obtained by adding the external additive to the toner particles, after the toner particles are prepared.

The toner particles may be prepared by either a dry preparing method (for example, a kneading and pulverizing method, or the like) or a wet preparing method (for example, an aggregating and coalescing method, a suspension polymerization method, a dissolution suspension method, or the like). The preparing method of the toner particles is not particularly limited to these preparing methods, and the well-known preparing method is adopted.

Among these, the toner particles may be obtained by the aggregating and coalescing method.

Specifically, for example, in a case where the toner particles are prepared by the aggregating and coalescing method, the toner particles are prepared via the following steps: a step of preparing a resin particle dispersion in which the resin particles as a binder resin are dispersed (a resin particle dispersion preparing step); a step of aggregating the resin particles (according to the necessity, other particles) in the resin particle dispersion (according to the necessity, in a dispersion after a dispersion of the other particles is mixed) to form aggregated particles (an aggregated particle forming step); and a step of heating an aggregated particle dispersion in which the aggregated particles are dispersed, and coalescing the aggregated particles to form the toner particles (a coalescing step).

Hereinafter, each step will be described in detail.

In addition, in the following description, a method for obtaining the toner particles including a coloring agent and a release agent will be described, but the coloring agent and the release agent are used according to the necessity. Certainly, other additives may be added other than the coloring agent and the release agent.

Resin Particle Dispersion Preparing Step

First, a resin particle dispersion, in which the resin particles as a binder resin are dispersed, is prepared with, for example, a coloring agent particle dispersion where the coloring agent particles are dispersed, and a release agent particle dispersion where the release agent particles are dispersed.

Here, the resin particle dispersion is prepared by, for example, dispersing the resin particles in a dispersion medium by a surfactant.

As the dispersion medium used for the resin particle dispersion, for example, an aqueous medium is exemplified.

Examples of the aqueous medium include water such as distilled water and ion exchanged water, and alcohols. The one type of the aqueous medium may be used alone or two or more types thereof may be used in combination.

Examples of the surfactant include an anionic surfactant such as a sulfate salt surfactant, a sulfonic acid salt surfactant, a phosphate ester surfactant, and a soap surfactant; a cationic surfactant such ay an amine salt surfactant and a quaternary ammonium salt surfactant; and a nonionic surfactant such as polyethylene glycol surfactant, an alkyl phenol ethylene oxide adduct surfactant, and a polyol surfactant. Among these, in particular, the anionic surfactant and the cationic surfactant are exemplified. The nonionic surfactant may be used in combination with the anionic surfactant or the cationic surfactant.

The one type of the surfactant may be used alone or two or more types thereof may be used in combination.

In the resin particle dispersion, examples of the method for dispersing the resin particles in the dispersion medium include a general dispersion method such as a rotary shear type homogenizer, and a ball mill, a sand mill, and a dyno mill, which have a media. In addition, depending on the type of the resin particles, for example, the resin particles may be dispersed in the resin particle dispersion using a phase inversion emulsification method.

In addition, the phase inversion emulsification method refers to a method, in which a resin to be dispersed is made to be dissolved in a hydrophobic organic solvent in which the resin maybe dissolved, a base is added to an organic continuous phase (O phase) to neutralize, and then an aqueous medium (W phase) is put into thereto, an exchange of the resin (a so-called phase inversion) is performed from W/O to O/W to become a noncontinuous phase, and the resin is dispersed in the aqueous medium in a particle shape.

The volume average particle diameter of the resin particles dispersed in the resin particle dispersion is, for example, preferably from 0.01 μm to 1 μm, more preferably from μm 0.08 to μm 0.8, and still more preferably from 0.1 μm to 0.6 μm.

In addition, the volume average particle diameter of the resin particles is measured in which the particle diameter distribution obtained by measurement of a laser diffraction particle diameter distribution measuring apparatus (for example, manufactured by HORIBA, Ltd., LA-700) is used, a cumulative distribution of the volume is drawn from a small particle diameter side with respect to the divided particle range (channel), and the particle diameter as cumulative 50% with respect to the total particles is measured as the volume average particle diameter D50v. Also, the volume average particle diameter of the particles in other dispersions is measured in the same manner.

The content of the resin particles included in the resin particle dispersion is, for example, preferably from 5% by weight to 50% by weight and more preferably from 10% by weight to 40% by weight.

In addition, in the same manner as the resin particle dispersion, for example, the coloring agent particle dispersion and the release agent particle dispersion are prepared. In other words, with regard to the volume average particle diameter of the particles, the dispersion medium, the dispersion method, and the content of the particles in the resin particle dispersion, the same applies to the coloring agent particles dispersed in the coloring agent particle dispersion, and the release agent particles dispersed in the release agent particle dispersion.

Aggregated Particles Forming Step

Next, the coloring agent particle dispersion and the release agent particle dispersion are mixed with the resin particle dispersion.

In addition, the aggregated particles are formed, which have the target diameter close to the diameter of the toner particles, by causing the resin particles, the coloring agent particles and the release agent particles to be hetero-aggregated in the mixed dispersion, and include the resin particles, the coloring agent particles, and the release agent particles.

Specifically, for example, an aggregating agent is added to a mixed dispersion, the pH of the mixed dispersion is adjusted to be acidic (for example, pH is from 2 to 5), a dispersion stabilizer is added thereto according to the necessity, and then the resin particles are heated up to the glass transition temperature (specifically, for example, glass transition temperature of the resin particles −30° C. or higher, glass transition temperature −10° C. or lower), and the particles dispersed in the mixed dispersion are aggregated to form the aggregated particles.

In the aggregated particles forming step, for example, after the mixed dispersion is stirred by the rotary shear type homogenizer, the aggregating agent is added thereto at room temperature (for example, 25° C.), the pH of the mixed dispersion is adjusted to be acidic (for example, pH is from 2 to 5), the dispersion stabilizer is added thereto according to the necessity, and then the heating may be performed.

Examples of the aggregating agent include a surfactant having reverse polarity to the surfactant used as the dispersant added in the mixed dispersion, an inorganic metal salt, and a divalent or higher metal complex. In particular, in a case where the metal complex is used as the aggregating agent, the use amount of the surfactant is reduced and charging properties are improved.

An additive having a complex or a similar bonding to the metal ion of the aggregating agent may be used according to the necessity. As the additive, a chelating agent is preferably used.

Examples of the inorganic metal salt include a metal salt such as calcium chloride, calcium nitrate, barium chloride, magnesium chloride, zinc chloride, aluminium chloride, and aluminium sulfate; and an inorganic metal salt copolymer such as polyaluminium chloride, polyaluminium hydroxide, and calcium polysulfide.

As the chelating agent, a water-soluble chelating agent may be used. Examples of the chelating agent include oxycarboxylic acid such as tartaric acid, citric acid, and gluconic acid, iminodiacetic acid (IDA), nitrilotriacetic acid (NTA), ethylenediaminetetraacetic acid (EDTA).

The addition amount of the chelating agent is, for example, preferably from 0.01 parts by weight to 5.0 parts by weight and more preferably from 0.1 parts by weight to 3.0 parts by weight With respect to 100 parts by weight of the resin particles.

Coalescing Step

Next, an aggregated particle dispersion having the aggregated particles dispersed therein is heated, for example, up to the glass transition temperature of the resin particles (for example, equal to or higher than the temperature from 10° C. to 30° C. higher than the glass transition temperature of the resin particles), and the aggregated particles are coalesced to form the toner particles.

Via the above steps, the toner particles are obtained.

In addition, the toner particles may be prepared via the following steps: a step of forming second aggregated particles in which after the aggregated particle dispersion having the aggregated particles dispersed therein is obtained, the aggregated particle dispersion and the resin particle dispersion having the resin particles dispersed therein are further mixed to each other so as to aggregate such that the resin particles are further attached to the surface of the aggregated particles; and a step of forming the toner particles having a core/shell structure in which a second aggregated particle dispersion having the second aggregated particles dispersed therein is heated to coalesce the second aggregated particles.

Here, after the coalescing step is finished, the toner particles formed in the solution is subjected to a well-known cleansing step, a solid liquid separating step, and a drying step to obtain the toner particles in a dried state.

As the cleansing step, it is preferable to sufficiently perform displacement cleansing using ion exchanged water from a viewpoint of charging properties. In addition, the solid liquid separating step is not particularly limited, but it is preferable to perform a suction filtration, a pressurization filtration, or the like from a viewpoint of productivity. In addition, the drying step is not particularly limited, but it is preferable to perform freeze drying, flash drying, fluidized drying, vibrating fluidized drying, or the like, from a viewpoint of productivity.

In addition, the toner used in the exemplary embodiment is prepared by for example, adding an external additive to the obtained dried toner particles and mixing the particles. It is preferable to perform mixing toy for example, V blender, HENSCHEL MIXER, LOEDIGE MIXER, or the like. Further, coarse particles stay be removed by using a vibrating sieving machine, air sieving machine, or the like, if necessary.

Carrier

The carrier for developing an electrostatic charge image used in the exemplary embodiment includes a core including a magnetic member in a core resin (a binder resin for a core) and a coating layer coating the surface of the core and including the coating resin (a resin for a coating layer), and the surface roughness Ra of the coating layer is from 0.25 μm to 0.4 μm.

Core

Surface Roughness Ra of Core

The surface roughness Ra of the core is preferably from 0.3 μm to 0.5 μm, more preferably from 0.35 μm to 0.5 μm, and still more preferably from 0.4 μm to 0.5 μm.

The ratio (Ra2/Ra1) of the surface roughness Ra2 of the carrier to the surface roughness Ra1 of the core is preferably from 0.72 to 0.83.

In addition, the surface roughness Ra of the core is measured by Super Depth Color 3D Profile Measuring Microscope (VK-9500, KEYENCE CORPORATION) based on JIS-B0601 (1994).

A method for controlling the surface roughness Ra of the core within the above range is not particularly limited, but when the number average particle diameter of the core is set to D(μm), the particles having a specific particle diameter are preferably contained in an area (hereinafter, simply referred to as an "outermost layer portion") down to ⅛ D(μm) from the surface of the core. Since the particles are contained in the outermost layer portion, the particles are protruded from the surface of the core to form ruggedness, and the surface roughness Ra is achieved. In addition, the particles having a specific particle diameter may be either magnetic member particles or non-magnetic member particles.

Also, the measurement of the number average particle diameter of the core is performed according to the following method.

30 parts by weight of a carrier is added to 70 parts by weight of a mixed liquid of two components adhesive QUICK 30 (manufactured by Konishi Co., Ltd.) and further mixed, and placed in an environment of 25° C. for 48 hours to cure the liquid. After the shape of the cured embedded product is regulated by a razor, the product is cut by Ultra Microtome (manufactured by LEICA, URUTRACUT UCT) provided with a diamond knife SK2035 (manufactured by Sumitomo Electric Industries, Ltd.) (surface shaping). Further, cutting is executed until a cut section is formed to be smooth, while smoothness of the cut section is further confirmed by an optical microscope, to prepare a test piece. A cross-sectional image of the test piece is obtained by observing the obtained test piece by a scanning electron microscope. The obtained image is taken in an image analyzing software WinROOF (manufactured by MITANI Corporation) to be a monochrome image and then analyzed. Thus, the number average particle diameter is measured. The measurement is performed 4 points per one carrier and is an average calculated from 50 carriers randomly selected.

Particles Contained in Outermost Layer Portion of Core

Specifically, particles having a particle diameter of 0.8 μm to 5 μm are preferably contained in the outermost layer portion of the core, particles having a particle diameter of 1.5 μm to 5 μm are more preferably, and particles having a particle diameter of 1.5 μm to 4 μm are still more preferable.

In addition, the measurement of the particle diameter of the particles contained in the outermost layer portion is performed such that the core surface observed by a scanning microscope is taken in an image analyzing software (WinROOF) to be a monochrome image, and then the particle diameter of the maximum portion is measured.

Since the particles whose particle diameter is within the above range are contained in the outermost layer portion of the core, it is considered that mixing and stirring of the toner and the carrier within a developing device are satisfactorily performed under high temperature and high humidity, the toner exists on the surface of the carrier without unevenness, and the image having excellent granularity is obtained.

Magnetic Member Particles

As the material of the magnetic member particles contained in the core, a magnetic metal such as iron, steel, nickel, and cobalt; an alloy of these and manganese, chromium, rare earth metal, or the like (for example, a nickel-iron alloy, a cobalt-iron alloy, an aluminium-iron alloy, or the like); and magnetic oxide such as ferrite and magnetite may be applied, and among these, ferrite and magnetite are preferable from a viewpoint of stable properties. The particle diameter of the magnetic member particles is preferably from 0.01 μm to 5 μm, more preferably from 0.1 μm to 2 μm, and still more preferably from 0.1 μm to 1 μm.

Area where Particles are Contained

The particles whose particle diameter is within the above range contained in the core are extremely preferably contained in the outermost layer portion of the core.

Binder Resin (Core Resin)

Examples of the binder resin configuring the core include a styrene resin, an acryl resin, a styrene-acryl copolymer resin, a polyolefin resin, and a phenol resin.

In addition, the core may further contain other components and example of the other components include a charge-controlling agent and fluorine-containing particles.

Method for Preparing Core

The method for preparing a core may be any well-known methods, for example, methods shown in the following (1) to (4).

(1) Molten-Kneading Method

The magnetic member and the binder resin are molten-kneaded using a banbury mixer, a kneader, or the like, and cooled. Then, the resultant is pulverized and classified.

(2) Suspension Polymerization Method

A monomer unit of the binder resin and the magnetic member are dispersed in a solvent to prepare a suspension, and the suspension is polymerized.

(3) Spray Dry Method

After the magnetic member is mixed and dispersed in a resin solution, the resultant is sprayed and dried.

(4) Polymerization Method

After a polymerizable monomer of the binder resin and the magnetic member are mixed, the composition is granule and polymerized. All of the above preparing methods include a step in which the magnetic member is prepared by any configurations, and the magnetic member particles and the binder resin are mixed to each other so as to include the magnetic member in the binder resin.

In addition, as a method for including the particles (either magnetic member particles or non-magnetic member particles, or may include both of them) whose particle diameter is within the above range in the outermost layer portion of the core, for example, in addition to a method for treating the magnetic member particles or the non-magnetic member particles included in the outermost layer portion of the core according to a method different from the method for treating the magnetic member included within the core, according to the above (1) "molten-kneading method", the method is exemplified in which the temperature is decreased when molten-kneading, and the particles are added in the latter half of the molten-kneading so as to be attached. In addition, according to the above (2) "suspension polymerization method" and (4) "polymerization method", the method is exemplified in which the particles are added so as to be attached while the polymerization is performed and before the polymerization is completed. According to the above (3) "spray dry method", the method is exemplified in which the particles are added in the latter half of the spraying so as to be attached.

In addition, according to these methods, the core is obtained in which a portion where the above particles exist in the outermost layer portion and the particles are included, and a portion where the particles are not included are integrally formed (the interface is not confirmed).

Coating Layer

The core surface is coated with the carrier used in the exemplary embodiment and the carrier has a coating layer including a coating resin (a resin for a coating layer).

The resin configuring the coating layer is not particularly limited and the resin is selected according to the necessity. Examples thereof include a resin, including a polyolefin resin such as polyethylene and polypropylene; a polyvinyl resin such as polystyrene, an acryl resin, polyacrylonitrile, polyvinyl acetate, polyvinyl alcohol, polyvinyl butyral, polyvinyl chloride, polyvinyl carbazole, polyvinyl ether and polyvinyl ketone, and a polyvinylidene resin; a vinyl chloride-vinyl acetate copolymer; a styrene-acrylic acid copolymer; a straight silicone resin including an organosiloxane bond or a modified product thereof; a fluorine resin such as polytetrafluoroethylene, polyvinyl fluoride, polyvinylidene fluoride, and polychlorotrifluoroethylene; a silicone resin; polyester; polyurethane; polycarbonate; a phenol resin; an amino resin such as an urea-formaldehyde resin, a melamine resin, a benzoguanamine resin, an urea resin, and a polyamide resin; an epoxy resin. In addition, examples thereof include a homopolymer of a monomer including a cycloalkyl group, a copolymer in which two or more types of the monomer including a cycloalkyl group are polymerized, and a copolymer of a monomer including a cycloalkyl group and a monomer not including a cycloalkyl group. One type of these may be used alone or two or more types thereof may be used in combination.

The coating layer may contain conductive particles in the coating resin. Here, conductivity means that volume resistivity is less than $10^7\Omega\cdot$cm.

Examples of the conductive particles include metal particles such as gold, silver, and copper; semiconductive oxide particles such as carbon black particles, titanium oxide, and zinc oxide; and particles in which the surface of titanium oxide, zinc oxide, barium sulfate, aluminium borate, and potassium titanate powders are coated with tin oxide, carbon black, and a metal. The one type of these may be used alone or two or more types thereof may be used in combination, Among these, carbon black particles are preferable.

The type of the carbon black is not particularly limited, and carbon black whose DBP oil absorption amount is from 50 ml/100 g to 250 ml/100 g is preferable.

The coating layer may contain wax. The wax is not particularly limited, and examples of the wax include low molecular weight polyolefin wax, carnauba wax, rice wax, candelilla wax, paraffin wax, microcrystal wax, Fischer Tropsch wax, and solid acid ester wax. Among these, in particular, paraffin wax and Fischer Tropsch wax are preferable.

The one type of these may be used alone or two or more types thereof may be used in combination.

In addition, the coating layer may contain resin particles. As the resin configuring the resin particles, a thermoplastic resin or a thermosetting resin is used.

In a case of a thermoplastic resin, examples thereof include a polyolefin resin, for example, polyethylene and polypropylene; a polyvinyl and polyvinylidene resin, for example, polystyrene, an acryl resin, polyacrylonitrile, polyvinyl acetate, polyvinyl alcohol, polyvinyl butyral, polyvinyl chloride, polyvinyl carbazole, polyvinyl ether and polyvinyl ketone; a vinyl chloride-vinyl acetate copolymer; a styrene-acrylic acid copolymer; a straight silicon resin including an organosiloxane bond or a modified product thereof; a fluorine resin, for example, polytetrafluoroethylene, polyvinyl fluoride, polyvinylidene fluoride, and polychlorotrifluoroethylene; polyester; and polycarbonate.

Examples of the thermosetting resin include a phenol resin; an amino resin, for example, a urea-formaldehyde resin, a melamine resin, a benzoguanamine resin, a urea resin, and a polyamide resin; and an epoxy resin.

Formation of Coating Layer

The method for forming the coating layer in the carrier used in the exemplary embodiment is not particularly limited as long as the carrier having the above configuration may be formed by the method. For example, the coating layer is prepared by a spray method in which a solution for forming a coating layer obtained by stirring dispersing a solution having a resin for coating dissolved therein using a stirring apparatus (for example, a sand mill, or the like) is sprayed on the surface of the core; and a kneader coater method in which the solution for forcing a coating layer and the core are mixed to each other in a kneader coater and subsequently, the solvent is removed.

Thickness of Coating Layer

The thickness of the coating layer is not particularly limited, and is preferably from 0.1 μm to 3.0 μm, more preferably from 0.2 μm to 2.0 μm, and particularly preferably from 0.2 μm to 1.0 μm.

In addition, the thickness of the coating layer is measured by the following method.

30 parts by weight of a carrier is added to 70 parts by weight of a mixed liquid of two components adhesive QUICK 30 (manufactured by Konishi Co., Ltd.), further mixed, and placed in an environment of 25° C. for 48 hours to cure the liquid. After the shape of the cured embedded product is regulated by a razor, the product, is cut by Ultra Microtome (manufactured by LEICA, URUTRACUT UCT) provided with a diamond knife SK2035 (manufactured by Sumitomo Electric Industries, Ltd.) (surface shaping). Further, cutting is executed until a cut section is formed to be smooth, while smoothness of the cut section is further confirmed by an optical microscope, to prepare a test piece. A cross-sectional image of the test piece is obtained by observing the obtained test piece by a scanning electron microscope. The obtained image is taken in an image analyzing software WinROOF (manufactured by MITANI Corporation) to be a monochrome image. Then, the thickness of the coating layer at 4 points with an interval of 90 degrees is measured with respect to one core randomly selected, and the measurement is repetitively performed with respect to 50 cores and the average value thereof is obtained by calculation.

The carrier used in the exemplary embodiment has almost smooth surface properties as the properties thereof, and ruggedness of the surface is represented by using surface roughness Ra as an index. The surface roughness Ra of the carrier, in other words, the surface roughness Ra of the coating layer configuring the surface is from 0.25 μm to 0.4 μm and preferably from 0.3 μm to 0.4 μm, from a viewpoint of preventing frictional charging inhibition (spacer effect of silica) between the toner and the carrier due to silica and adhesion of the silica to the carrier, which is a cause, in particular, with regard to preventing deletion in an image (image defect). In a case where Ra is less than 0.25 μm, the spacer effect of the silica becomes greater, and deterioration in deletion (image defect) due to an increase in resistance of the carrier is caused. Meanwhile, in a case where Ra is greater than 0.4 μm, the initial increase in resistance of the carrier is prevented; however, the silica movement amount to the carrier after the use for a long period of time is increased, and an image defect such as a decrease in concentration of the image is caused.

The volume average particle diameter of the carrier is preferably from 10 μm to 100 μm and still more preferably from 20 μm to 50 μm. If the volume average particle diameter is 10 μm or more, a developer is prevented from being scattered from a developing device, and if the volume average particle diameter is 100 μm or less, an image concentration in the image to be formed is increased.

Here, a method for measuring the volume average particle diameter is as follows.

A particle diameter distribution is measured using a laser diffraction/scattering particle diameter distribution measuring apparatus (LS Particle Size Analyzer (manufactured by Beckman Coulter, Inc.)). The ISOTON-II (manufactured by Beckman Coulter, Inc.) is used as an electrolyte. The number of particles to be measured is 50,000.

In addition, in the measured particle diameter distribution, a cumulative distribution of the volume is drawn from a small particle diameter side with respect to the divided particle range (channel), and the particle diameter as cumulative 50% (represented by "D50v") is defined as a "volume average particle diameter".

A mixed ratio (weight ratio) of the toner to the carrier in the developer according to the exemplary embodiment (toner:carrier) is preferably 1:100 to 30:100 and more preferably 3:100 to 20:100.

Image Forming Apparatus/Image Forming Method

The image forming apparatus/image forming method according to the exemplary embodiment will be described.

The image forming apparatus according to the exemplary embodiment includes an image holding member; a charging unit for charging the surface of the image holding member; an electrostatic charge image forming unit for forming an electrostatic charge image on the charged surface of the image holding member; a developing unit for accommodating an electrostatic charge image developer and developing the electrostatic charge image formed on the surface of the image holding member by the electrostatic charge image developer as a toner image; a transferring unit for transferring the toner image formed on the surface of the image holding member to the surface of a recording medium; and a fixing unit for fixing the toner image transferred on the surface of the recording medium. In addition, the electrostatic charge image developer according to the exemplary embodiment is applied as the electrostatic charge image developer.

In the image forming apparatus according to the exemplary embodiment, an image forming method (the image forming method according to the exemplary embodiment) is executed, which includes charging the surface of an image holding member; forming an electrostatic charge image on the charged surface of the image holding member; developing the electrostatic charge image formed on the surface of the image holding member by the electrostatic charge image developer according to the exemplary embodiment as a toner image; transferring the toner image formed on the surface of the image holding member to the surface of a recording medium; and fixing the toner image transferred to the surface of the recording medium.

As the image forming apparatus according to the exemplary embodiment, the well-known image forming apparatus is applied, such as an apparatus of a direct transfer system which directly transfers a toner image formed to the surface of an image holding member to a recording medium; an apparatus of an intermediate transfer system which primarily transfers a toner image formed on the surface of an image holding member to the surface of an intermediate transfer member and secondarily transfer the toner image transferred to the surface of the intermediate transfer member to the surface of a recording medium; an apparatus which includes a cleaning unit for cleaning the surface of an image holding member after a toner image is transferred and before being charged; and an apparatus which includes an erasing unit for erasing a toner image by irradiating the surface of an image holding member with erasing light after the toner image is transferred and before being charged.

In a case of the apparatus of an intermediate transfer system, as the transferring unit, for example, a configuration is applied, which includes an intermediate transfer member where a toner image on the surface is transferred; a primary transferring unit for primarily transfer a toner image formed on the surface of an image holding member to the surface of an intermediate transfer member; and a secondary transferring unit for secondarily transfer the toner image transferred to the surface of the intermediate transfer member to the surface of a recording medium.

In addition, in the image forming apparatus according to the exemplary embodiment, for example, a portion including the developing unit may have a cartridge structure (a process cartridge) detachable from the image forming apparatus. As the process cartridge, for example, a process cartridge which includes a developing unit where the electrostatic charge image developer according to the exemplary embodiment is accommodated.

Hereinafter, one example of the image forming apparatus according to the exemplary embodiment will be shown, but the image forming apparatus is not limited to this. Also, main parts shown in the drawing will be described and description of other parts will be omitted.

Figure 2:
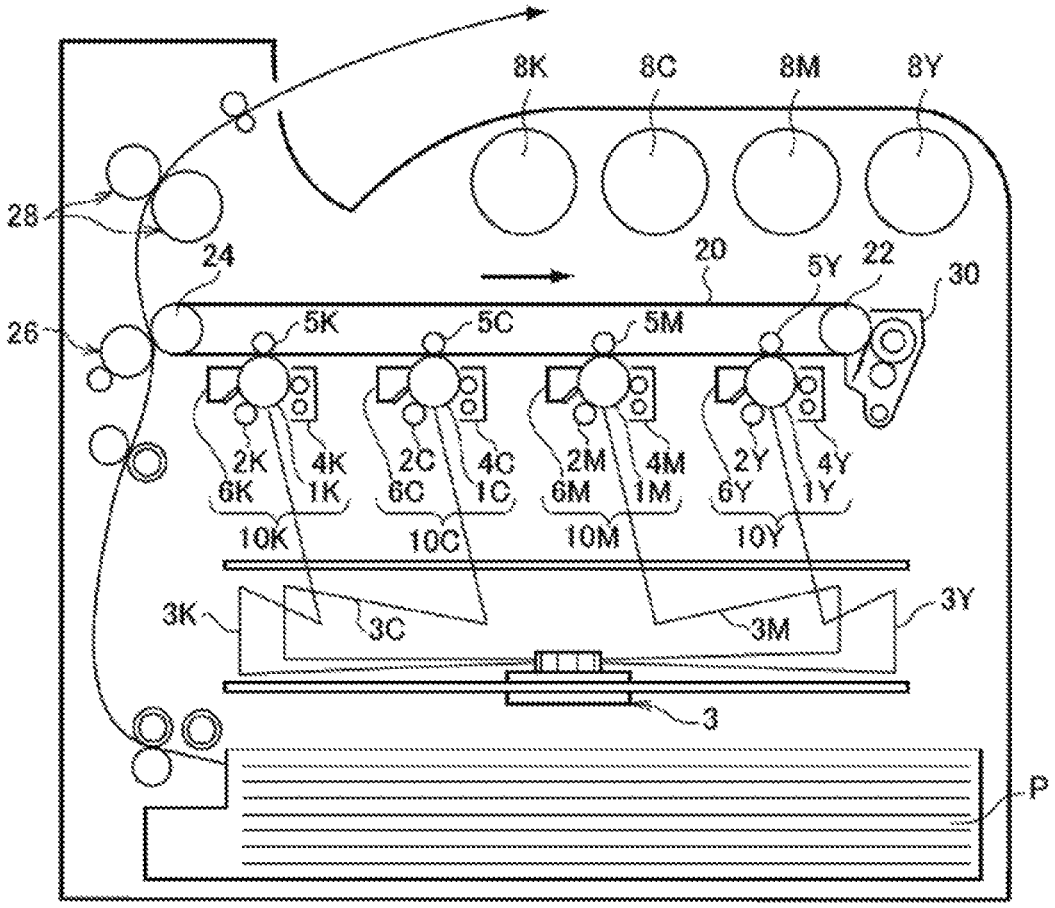
FIG. 2 is a configuration diagram schematically illustrating an example of an image forming apparatus according to an exemplary embodiment.

FIG. 2 is a configuration diagram schematically illustrating an image forming apparatus according to an exemplary embodiment.

The image forming apparatus shown in FIG. 2 includes electrophotographic first to fourth image forming units 10Y, 10M, 10C, and 10K (an image forming unit) which output an image of respective colors including yellow (Y), magenta (M), cyan (C), and black (K) based on color separated image data. These image forming units (hereinafter, simply referred to as a "unit") 10Y, 10M, 10C, and 10K are arranged in parallel being separated to each other with a predetermined distance in a horizontal direction. In addition, these units 10Y, 10M, 10C, and 10K may be a process cartridge detachable from the image forming apparatus.

An intermediate transfer belt 20 is extensively provided as an intermediate transfer member through respective units in the above of the drawing of respective units 10Y, 10M, 10C, and 10K. The intermediate transfer belt 20 is provided by being wounded by a driving roll 22 disposed being separated from each other from a left to right direction in the drawing and a support roll 24 contacting with the inner surface of the intermediate transfer belt 20, and is configured to travel in a direction from a first unit 10Y to a fourth unit 10K. Also, a force is added to the support roll 24 in a direction separating from the driving roll 22 by a spring or the like (not illustrated), and tension is imparted to the intermediate transfer belt 20 wounded by both rolls. In addition, an intermediate transfer member cleaning device 30 facing the driving roll 22 is included on the side surface of the image holding member of the intermediate transfer belt 20.

In addition, a toner including four colors of yellow, magenta, cyan, and black accommodated in toner cartridges 8Y, 8M, 8C, and 8K is supplied to each developing device (a developing unit) 4Y, 4M, 4C, or 4K of each unit 10Y, 10M, 10C, or 10K.

Since the first to fourth units 10Y, 10M, 10C, and 10K have the same configuration, here, the first unit 10Y which forms a yellow image and is disposed on the upstream side in the traveling direction of the intermediate transfer belt will be representatively described. In addition, the descriptions for the second to fourth units 10M, 10C, and 10K will be omitted by attaching reference symbols of magenta (M), cyan (C), and black (K) to the same part as that of the first unit 10Y, instead of yellow (Y).

The first unit 10Y has a photoreceptor 1Y acting as an image holding member. In the periphery of the photoreceptor 1Y, a charging roll (one example of the charging unit) 2Y for charging the surface of the photoreceptor 1Y to a predetermined electric potential, an exposing device (one example of the electrostatic charge image forming unit) 3 for forming an electrostatic charge image by exposing the charged surface to a laser beam 3Y based on a color separated image signal, a developing device (one example of the developing unit) 4Y for developing the electrostatic charge image by supplying a charged toner to the electrostatic charge image, a primary transfer roll 5Y (one example of the primary transferring unit) for transferring the developed toner image to the intermediate transfer belt 20, and a photoreceptor cleaning device (one example of the cleaning unit) 6Y for removing the toner remaining on the surface of the photoreceptor 1Y after the primary transfer, are sequentially disposed.

In addition, the primary transfer roll 5Y is disposed in the inner side of the intermediate transfer belt 20, and is provided in a position facing the photoreceptor 1Y. Further, a bias power supply (not illustrated) for applying a primary transfer bias is respectively connected to the respective primary transfer rolls 5Y, 5M, 5C, and 5K. The respective bias power supplies may change the transfer bias to be applied to the respective primary transfer rolls by control of a control unit (not illustrated).

Hereinafter, an operation for forming a yellow image of the first unit 10Y will be described.

First, prior to the operation, the surface of the photoreceptor 1Y is charged to an electric potential of −600 V to −800 V by a charging roll 2Y.

The photoreceptor 1Y is formed by laminating a photosensitive layer on a conductive (for example, volume resistivity at a temperature of 20° C.: $1\times10^{-6}\Omega$cm or less) base member. This photosensitive layer has commonly high resistance (in general, resistance of a resin), and if the photosensitive layer is irradiated with a laser beam 3Y, the photosensitive layer has properties in which the specific resistance of the portion having been irradiated with a laser beam is changed. In addition, the laser beam 3Y is output to the surface of the charged photoreceptor 1Y via the exposing device 3, according to image data for yellow delivered from the control unit (not illustrated). The photosensitive layer on the surface of the photoreceptor 1Y is irradiated with the laser beam 3Y and an electrostatic charge image of a yellow image pattern is formed on the surface of the photoreceptor 1Y.

The electrostatic charge image is an image formed on the surface of the photoreceptor 1Y by charging, and is a so-called negative latent image, which is formed as follows: specific resistance of a portion of the photosensitive layer to be irradiated with the laser beam 3Y is decreased, and an electric charge charged on the surface of the photoreceptor 1Y flows, but the electric charge remains on the portion not having been irradiated with the laser beam 3Y.

The electrostatic charge image formed on the photoreceptor 1Y is rotated to the predetermined developing position according to the traveling of the photoreceptor 1Y. In addition, in this developing position, the electrostatic charge image on the photoreceptor 1Y becomes a visualized image (developed image) as a toner image by the developing device 4Y.

The electrostatic charge image developer including, for example, at least the yellow toner and the carrier is accommodated within the developing device 4Y. The yellow toner is frictionally charged by being stirred within the developing device 4Y, and has an electric charge with the same polarity (negative polarity) as that of the electric charge charged on the photoreceptor 1Y so as to be kept on a developer roll (one example of a developer holding member). In addition, as the surface of the photoreceptor 1Y passes through the developing device 4Y, the yellow toner is electrostatically attached to a latent image portion erased on the surface of the photoreceptor 1Y, and the latent image is developed by the yellow toner. Subsequently, the photoreceptor 1Y where a yellow toner image is formed travels at a predetermined speed, and the toner image developed on the photoreceptor 1Y is fed to a predetermined primary transfer position.

Here, the developing device 4Y may be a developing device of a trickle developing system which develops an image while a part of the carrier in the accommodated developer is exchanged (discharge and supply).

In addition, in a case where the developing device 4Y is a developing device of a trickle developing system, a configuration may be adopted in the developing device, in which a developer for supplying is supplied by connecting a developer cartridge having a developer including the yellow toner and the carrier accommodated therein, instead of the toner cartridge 8Y, with a developer supply tube (not illustrated).

In addition, the carrier to be discharged includes a carrier deteriorated by stirring within the developing device 4Y.

If the yellow toner image on the photoreceptor 1Y is fed to a primary transfer roll, a primary transfer bias is applied to the primary transfer roll 5Y, an electrostatic force from the photoreceptor 1Y toward the primary transfer roll 5Y acts on the toner image, and the toner image on the photoreceptor 1Y is transferred on the intermediate transfer belt 20. The transfer bias to be applied at this time has (+) polarity which is a reverse polarity to the polarity (−) of the toner, and for example, in the first unit 10Y, the bias is controlled to +10 μA by the control unit (not illustrated).

Meanwhile, the toner remaining on the photoreceptor 1Y is removed by the photoreceptor cleaning device 6Y and collected.

In addition, the primary transfer bias to be applied to the primary transfer rolls 5M, 5C, and 5K after the second unit 10M is controlled based on the first unit.

In this way, the intermediate transfer belt 20 where the yellow toner image is transferred by the first unit 10Y is sequentially fed through the second to fourth units 10M, 10C, and 10K and the toner images with respective colors are overlapped and transferred in a multiple manner.

The intermediate transfer belt 20 where four-color toner images are transferred in a multiple manner through the first to fourth units reaches a secondary transfer portion configured to include the intermediate transfer belt 20, the support roll 24 contacting with the inner surface of the intermediate transfer belt, and a secondary transfer roll (one example of the secondary transferring unit) 26 disposed on the image holding surface side of the intermediate transfer belt 20. Meanwhile, a recording sheet (one example of the recording medium) P is supplied via a supplying mechanism at a predetermined timing to the space where the secondary transfer roll 26 and the intermediate transfer belt 20 contact with each other, and the secondary transfer bias is applied to the support roll 24. The transfer bias to be applied at this time has (−) polarity which is the same polarity as the polarity (−) of the toner, the electrostatic force from the intermediate transfer belt 20 toward the recording sheet P acts on the toner image, and the toner image on the intermediate transfer belt 20 is transferred to the recording sheet P. In addition, the secondary transfer bias at this time is determined depending on resistance detected by a resistance detection unit (not illustrated) for detecting resistance of the secondary transfer portion, and voltage-controlled.

After that, the recording sheet P is fed to a nip portion of a pair of fixing rolls in a fixing device (one example of the fixing unit) 28, the toner image is fixed on the recording sheet P, and the fixed image is formed.

As the recording sheet P on which the toner image is transferred, a plain paper used for an electrophotographic copying machine, a printer, or the like is exemplified. As the recording medium, an OHP sheet is exemplified other than the recording sheet P.

In order to improve smoothness of the surface of the fixed image, the surface of the recording sheet P is preferably smooth, and for example, a coated paper in which the surface of the plain paper is coated with a resin, an art paper for printing, or the like is preferably used.

The recording sheet P in which fixing of the color image is completed is discharged to a discharging portion and an operation of forming a series of color images is finished.

Process Cartridge/Developer Cartridge

The process cartridge according to the exemplary embodiment will be described.

The process cartridge according to the exemplary embodiment is a process cartridge detachable from the image forming apparatus, which accommodates the electrostatic charge image developer according to the exemplary embodiment, and includes a developing unit for developing an electrostatic charge image formed on the surface of an image holding member by an electrostatic charge image developer as a toner image.

In addition, the process cartridge according to the exemplary embodiment is not limited to the above configuration, and may have a configuration which includes a developing device, additionally, for example, at least one selected from other units such as an image holding member, a charging unit, an electrostatic charge image forming unit, and a transferring unit, if necessary.

Hereinafter, one example of the process cartridge according to the exemplary embodiment will be shown, but the process cartridge is not limited to this example. In addition, major portions shown in the drawing will be described and the description of others will be omitted.

Figure 3:
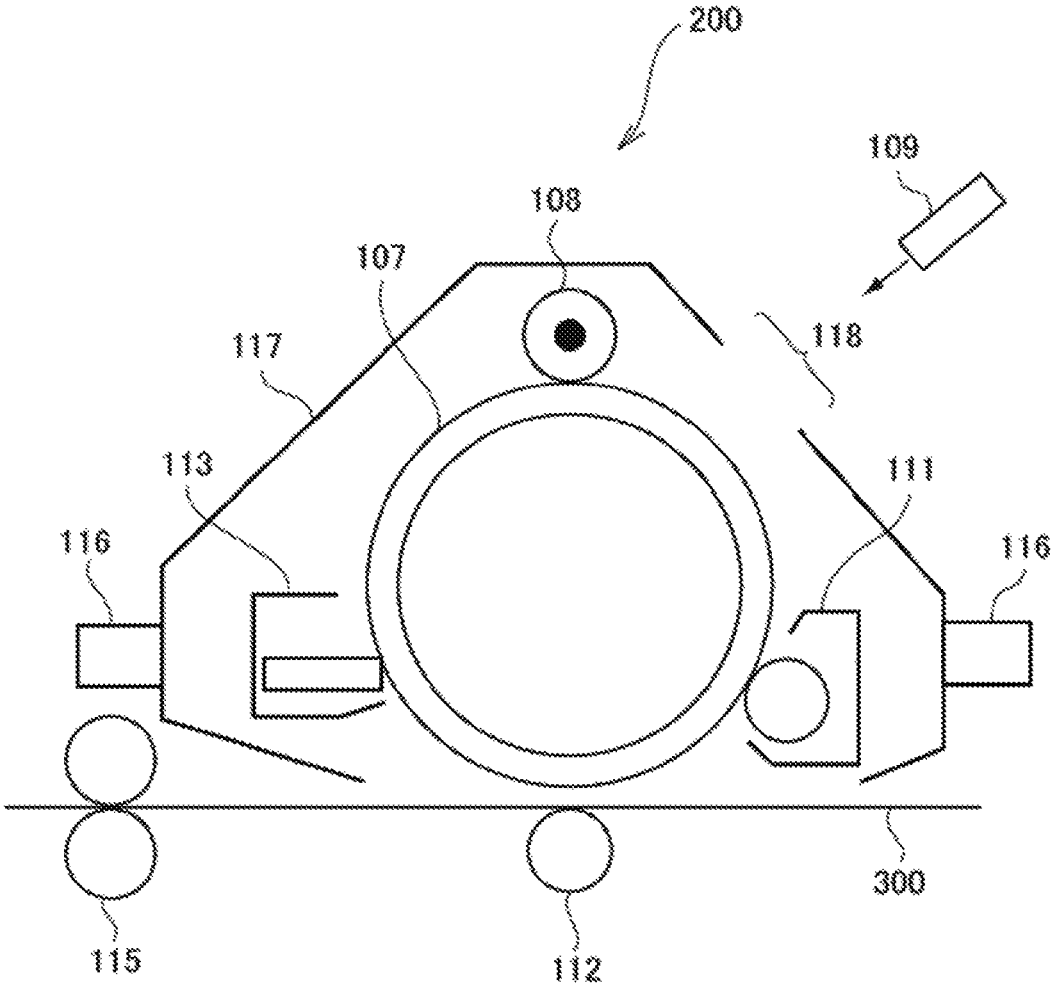
FIG. 3 is a configuration diagram schematically illustrating an example of a process cartridge according to the exemplary embodiment.

FIG. 3 is a configuration diagram schematically illustrating the process cartridge according to the exemplary embodiment.

The process cartridge 200 shown in FIG. 3 is configured such that, for example, a photoreceptor 107 (one example of the image holding member), a charging roll 108 included in the periphery of the photoreceptor 107 (one example of the charging unit), a developing device 111 (one example of the developing unit), and a photoreceptor cleaning device 113 (one example of the cleaning unit) are integrally combined and kept by a housing 117 including a mounting rail 116 and an opening 118 for exposure, so as to be a cartridge.

In addition, in FIG. 3, a reference numeral 109 indicates an exposing device (one example of the electrostatic charge image forming unit), a reference numeral 112 indicates a transferring device (one example of the transferring unit), a reference numeral 115 indicates a fixing device (one example of the fixing unit), and a reference numeral 300 indicates a recording sheet (one example of the recording medium).

Next, the developer cartridge according to the exemplary embodiment will be described.

The developer cartridge according to the exemplary embodiment is a developer cartridge which contains the developer according to the exemplary embodiment and is detachable from the image forming apparatus. The developer cartridge is a cartridge which contains a developer for supplying to supply a developer to the developing unit provided within the image forming apparatus. The developer cartridge may have a container which contains the developer.

The developer cartridge according to the exemplary embodiment is preferably applied to the image forming apparatus including a trickle system developing device.

For example, the image forming apparatus shown in FIG. 2 may be an image forming apparatus, in which developing is performed, while the toner cartridges 8Y, 8M, 8C, and 8K are exchanged to the developer cartridge according to the exemplary embodiment, the developer is supplied from this developer cartridge to the developing devices 4Y, 4M, 4C, and 4K, and the carrier accommodated in the developing devices 4Y, 4M, 4C, and 4K is exchanged.

In addition, in a case where the developer accommodated within the developer cartridge is reduced, the developer cartridge is exchanged.

EXAMPLES

Hereinafter, the exemplary embodiment will be described using Examples, but the exemplary embodiment is not limited to these Examples. In addition, in the following description, particularly, unless otherwise mentioned, all of the "parts" and "%" means "parts by weight" and "% by weight".

Preparation of Toner Particles

Preparation of Resin Particle Dispersion (1)

After 10 parts by mole of polyoxyethylene (2,0)-2,2-bis(4-hydroxyphenyl)propane, 90 parts by mole of polyoxypropylene(2,2)-2,2-bis(4-hydroxyphenyl)propane, 10 parts by mole of terephthalic acid, 67 parts by mole of fumaric acid, 3 parts by mole of n-dodecenyl succinic acid, 20 parts by mole of trimellitic acid, and 0.05 parts by mole of dibutyltin oxide are put into a heated and dried two necked flask, a nitrogen gas is introduced into the container and heated retaining an inert atmosphere. Then, the resultant, is co-condensation polymerized for 15 hours while the temperature is retained from 150° C. to 230° C., and then is slowly evacuated while the temperature is retained from 210° C. to 250° C., thereby synthesizing a polyester resin (1). The weight average molecular weight Mw of the polyester resin (1) is 130,000 and the glass transition temperature Tg is 73° C.

After 3,000 parts of the obtained polyester resin (1), 10,000 parts of ion exchanged water, and 90 parts of a surfactant sodium dodecyl benzenesulfonate are put into an emulsifying tank of a high temperature-high pressure emulsifying apparatus (Cavitron CD1010, slit: 0.4 mm), the resultant is heated and melted at a temperature of 130° C. and then dispersed at a temperature of 110° C., a flow rate of 3 L/minutes, a rotation of 10,000, and for 30 minutes, so as to pass through a cooling tank and collect a resin particle dispersion, thereby obtaining a resin particle dispersion (1).

Preparation of Resin Particle Dispersion (2)

After 44 parts by mole of 1,9-nonanediol, 56 parts by mole of dodecane dicarboxylic acid, and 0.05 parts by mole of dibutyltin oxide as a catalyst are put into a heated and dried three necked flask, the air within the container is made to an inert atmosphere using a nitrogen gas by an evacuating operation, and the resultant is mechanically stirred at a temperature of 180° C. for 2 hours. After that, the temperature of the resultant is slowly increased, up to a temperature of 230° C. under evacuation, stirred for 5 hours, and cooled when the resultant becomes a viscous state, and the reaction is stopped so as to synthesize a polyester resin (2). The weight average molecular weight Mw of the polyester resin (2) is 27,000 and the melting temperature Tm is 72° C. After that, a resin particle dispersion (2) is obtained using a high temperature high pressure emulsifying apparatus (Cavitron CD1010, slit: 0.4 mm), under the same condition as preparation of the resin particle dispersion (1) except that the polyester resin (2) is used instead of the polyester resin (1).

Preparation of Coloring Agent Dispersion

Carbon black (manufactured by Cabot Corporation R330): 25 parts

Anionic surfactant (manufactured by DKS Co. Ltd., NEOGEN RK): 2 parts

Ion exchanged water: 125 parts

The above components are mixed, dissolved, and dispersed using a high pressure shocking disperser ALTIMIZER (manufactured by SUGINO MACHINE LIMITED, HJP30006) for 1 hour, and a coloring agent dispersion obtained by dispersing a coloring agent (carbon black) is prepared. The volume average particle diameter of the coloring agent (carbon black) in the coloring agent dispersion is 0.12 μm and the concentration of the coloring agent particles is 24% by weight.

Preparation of Release Agent Dispersion

Paraffin wax (NIPPON SEIRO CO., LTD. HNP0190): 100 parts

Anionic Surfactant (manufactured by NOF Corporation, NEW-REX R): 2 parts

Ion exchanged water: 300 parts

After the above components are heated at a temperature of 95° C. and dispersed using a homogenizer (manufactured by IKA, ULTRA-TURRAX T50), the resultant is dispersed by a pressure discharging Gaulin homogenizer (Gaulin Co.), and a release agent dispersion (concentration of the release agent: 20% by weight) obtained by dispersing the releasing agent whose volume average particle diameter is 200 nm is prepared.

Preparation of Toner Particles (1)

Resin particle dispersion (1): 320 parts

Resin particle dispersion (2): 80 parts

Coloring agent dispersion: 50 parts

Release agent dispersion: 60 parts

Aluminium sulfate (manufactured by Wako Pure Chemical Industries, Ltd.): 15 parts Tin chloride (manufactured by Wako Pure Chemical Industries, Ltd.): 5 parts Surfactant aqueous solution: 10 parts 0.3M nitric acid aqueous solution: 50 parts Ion exchanged water: 500 parts After the above components are accommodated in a round-bottom flask made of a stainless steel and dispersed using a homogenizer (manufactured by IKA, ULTRA-TURRAX T50), the resultant is heated while the resultant is stirred in an oil bath for heating up to a temperature of 45° C. After the resultant is kept at a temperature of 48° C., in the stage in which it is confirmed that aggregated particles whose average particle diameter is 5.2 μm are formed, 100 parts of additional resin particle dispersion (2) is added thereto and then kept for 30 minutes. Subsequently, after 0.5 parts of 10% EDTA (ethylenediaminetetraacetic acid) metal salt aqueous solution (Chelest Mg.40, manufactured by CHELEST CORPORATION) is added thereto, 1N sodium hydroxide aqueous solution is gently added thereto until the pH reaches 7.0. After that, the resultant is heated to a temperature of 90° C. while the resultant is continuously stirred, and kept for 2 hours. Then, a reaction product is filtrated, washed with ion exchanged water, and then dried using a vacuum drier so as to obtain toner particles (1). As a result of measuring the volume average particle diameter D50v of the toner particles (1), the volume average particle diameter D50v is 6.2 μm and the volume average particle diameter distribution index GSDv is 1.20. As a result of observing the toner particles using Luzex image analyzer manufactured by Luzex, it is observed that the shape factor SF1 of the particles is 135 and the particles are non-spherical. Also, the glass transition temperature of the toner particles (1) is 52° C.

Preparation of External Additive

Preparation of Silica Particle Dispersion (1)

300 parts of methanol and 70 parts of 10% ammonia aqueous solution are added to a 1.5 L reaction vessel made of a glass equipped with a stirrer, a dripping nozzle, and a thermometer and mixed so as to obtain an alkali catalyst solution.

After this alkali catalyst solution is adjusted to a temperature of 30° C., 185 parts of tetramethoxysilane and 50 parts of 8.0% ammonia aqueous solution are added dropwise to the solution, while the solution is stirred, and a hydrophilic silica particle dispersion (solid content concentration of 12.0% by weight) is obtained. Here, the dripping time is 30 minutes.

After that, the obtained silica particle dispersion is concentrated to the solid content concentration of 40% by weight using a rotary filter R-FINE (manufactured by KOTOBUKI KOGYOU CO., LTD.). This concentrated dispersion is a silica particle dispersion (1).

Preparation of Silica Particle Dispersions (2) to (8)

In the preparation of the silica particle dispersion (1), silica particle dispersions (2) to (8) are prepared in the same manner as the silica particle dispersion (1), except that the alkali catalyst solution (methanol amount and 10% ammonia aqueous solution amount) and a production condition of the silica particles (tetramethoxysilane (written as TMOS) to the alkali catalyst solution, total dripping amount of 8% ammonia aqueous solution, and dripping time) are changed according to Table 1.

Hereinafter, the details of the silica particle dispersions (1) to (8) are summarized in Table 1.

TABLE 1

| | Alkali catalyst solution | | Production condition for silica particles | | |
|---|---|---|---|---|---|
| Silica particle dispersion | Methanol (parts) | 10% ammonia aqueous solution (parts) | Total dripping amount of TMOS (parts) | Total dripping amount of 8% ammonia aqueous solution (parts) | Dripping time |
| (1) | 300 | 70 | 185 | 50 | 30 mins |
| (2) | 300 | 70 | 340 | 92 | 55 mins |
| (3) | 300 | 46 | 40 | 25 | 30 mins |
| (4) | 300 | 70 | 62 | 17 | 10 mins |
| (5) | 300 | 70 | 700 | 200 | 120 mins |
| (6) | 300 | 70 | 500 | 140 | 85 mins |
| (7) | 300 | 70 | 1000 | 280 | 170 mins |
| (8) | 300 | 70 | 3000 | 800 | 520 mins |

Preparation of Surface Treated Silica Particles (S1)

The silica particles are surface treated with a siloxane compound under the atmosphere of supercritical carbon dioxide using the silica particle dispersion (1) as shown below. In addition, for the surface treatment, an apparatus including a carbon dioxide bombe, a carbon dioxide pump, an entrainer pump, an autoclave with a stirrer (capacity of 500 ml), and a pressure valve is used.

First, 250 parts of the silica particle dispersion (1) is put into the autoclave with a stirrer (capacity of 500 ml) and the stirrer is rotated at 100 rpm. After that, liquefied carbon dioxide is injected into the autoclave, the pressure thereof is increased by the carbon dioxide pump while the temperature thereof is increased by a heater, and the inside of the autoclave is made to a supercritical state of 150° C. and 15 MPa. The supercritical carbon dioxide is made to circulate by the carbon dioxide pump while the inside of the autoclave is retained to 15 MPa by the pressure valve and the methanol and water are removed from the silica particle dispersion (1) (the solvent removing step) so as to obtain silica particles (untreated silica particles).

Next, circulation of the supercritical carbon dioxide is stopped at the time when the amount of circulated supercritical carbon dioxide (estimated amount: measured as the circulation amount of carbon dioxide in a standard state) becomes 900 parts.

After that, in a state where the temperature is retained to 150° C. by the heater and the pressure is retained to 15 MPa by the carbon dioxide pump so as to retain the supercritical state of the carbon dioxide within the autoclave, a solution of a treating agent obtained by dissolving 0.3 parts of a dimethyl silicone oil (DSO: trade name "KF-96 (manufactured by Shin-Etsu Chemical Co., Ltd.)") having a viscosity of 10,000 cSt as the siloxane compound in 20 parts of hexamethyl disilazane (HMDS: manufactured by YUKI GOSEI KOGYO CO., LTD.) as the hydrophohizing agent, is injected into the autoclave by an entrainer pump in advance with respect to 100 parts of the above silica particles (untreated silica particles). Then, the resultant is reacted at a temperature of 180° C. for 20 minutes while the resultant is stirred. After that, the supercritical carbon dioxide is circulated again and a residual solution of the treating agent is removed. After that, the stirring is stopped, the pressure within the autoclave is kept to open to air pressure by opening the pressure valve, and the temperature is decreased to room temperature (25° C.).

As such, the solvent removing step and the surface treatment by the siloxane compound are performed sequentially so as to obtain surface treated silica particles (S1).

Preparation of Surface Treated Silica Particles (S2) to (S5), (S7) to (S9), and (S12) to (S17)

Surface treated silica particles (S2) to (S5), (S7) to (S9), and (S12) to (S17) are prepared in the same manner as the surface treated silica particles (S1), except that the silica particle dispersion and the surface treatment condition (the treatment atmosphere, the siloxane compound (type, viscosity, and addition amount thereof), and the hydrophobizing agent and the addition amount thereof) are changed according to Table 2, in the preparation of the surface treated silica particles (S1).

Preparation of Surface Treated Silica Particles (S6)

The surface treatment by the siloxane compound is performed with respect to the silica particles under air atmosphere using the same dispersion as the silica particle dispersion (1) used in the preparation of the surface treated silica particles (S1) as shown below.

An ester adapter and a cooling tube are amounted to the reaction vessel used in the preparation of the silica particle dispersion (1), the silica particle dispersion (1) is heated to a temperature of 60° C. to 70° C., and methanol is distilled. At that time, water is added thereto, and the dispersion is further heated to a temperature of 70° C. to 90° C., and methanol is distilled, thereby obtaining an aqueous dispersion of the silica particles. 3 parts of methyl trimethoxysilane (MTMS: manufactured by Shin-Etsu Chemical Co., Ltd.) is added to 100 parts of silica solid content in this aqueous dispersion at room temperature and reacted for 2 hours so as to perform surface treatment of the silica particles. After methyl isobutyl ketone is added to this surface treated dispersion, the resultant is heated to a temperature of 80° C. to 110° C., methanol water is removed, 80 parts of hexamethyl disilazane (HMDS: manufactured by YUKI GOSEI KOGYO CO., LTD.) and 1.0 part of dimethyl silicone oil (DSO: trade name "KF-96 (manufactured by Shin-Etsu Chemical Co., Ltd.)") having a viscosity of 10,000 cSt as the siloxane compound are added to 100 parts of silica solid content in the obtained dispersion at room temperature, reacted at a temperature of 120° C. for 3 hours, and cooled. Then, the resultant is dried by a spray drier and the surface treated silica particles (S6) are obtained.

Preparation of Surface Treated Silica Particles (S10)

The surface treated silica particles (S10) are prepared based on the surface treated silica particles (S1), except that fumed silica OX50 (AEROSIL OX 50, manufactured by NIPPON AEROSIL CO., LTD) is used instead of the silica particle dispersion (1). In other words, 100 parts of OX50 is injected into the autoclave with a stirrer in the same manner as the preparation of the surface treated silica particles (S1) and the stirrer is rotated at 100 rpm. After that, liquefied carbon dioxide is injected into the autoclave, the pressure thereof is increased by the carbon dioxide pump while the temperature thereof is increased by a heater, and the inside of the autoclave is made to a supercritical state of 180° C. and 15 MPa. While the inside of the autoclave is retained to 15 MPa by the pressure valve, a solution of a treating agent obtained by dissolving 0.3 parts of a dimethyl silicone oil (DSO: trade name "KF-96 (manufactured by Shin-Etsu Chemical Co., Ltd.)") having a viscosity of 10,000 cSt as the siloxane compound in 20 parts of hexamethyl disilazane (HMDS: manufactured by YUKI GOSEI KOGYO CO., LTD.) as the hydrophobizing agent, is injected into the autoclave by an entrainer pump in advance. Then, the resultant is reacted at a temperature of 180° C. for 20 minutes, while the resultant is stirred. After that, the supercritical carbon dioxide is circulated and a residual solution of the treating agent is removed so as to obtain surface treated silica particles (S10).

Preparation of Surface Treated Silica Particles (S11)

The surface treated silica particles (S11) are prepared based on the surface treated silica particles (S1), except that fumed silica A50 (AEROSIL A50, manufactured by NIPPON AEROSIL CO., LTD) is used instead or the silica particle dispersion (1). In other words, 100 parts of A50 is injected into the autoclave with a stirrer in the same manner as the preparation of the surface treated silica particles (S1) and the stirrer is rotated at 100 rpm. After that, liquefied carbon dioxide is injected into the autoclave, the pressure thereof is increased by the carbon dioxide pump while the temperature thereof is increased by a heater, and the inside of the autoclave is made to a supercritical state of 180° C. and 15 MPa. While the inside of the autoclave is retained to 15 MPa by the pressure valve, a solution of a treating agent obtained by dissolving 1.0 part of a dimethyl silicone oil (DSO: trade name "KF-96 (manufactured by Shin-Etsu Chemical Co., Ltd.)") having a viscosity of 10,000 cSt as the siloxane compound in 40 parts of hexamethyl disilazane (HMDS: manufactured by YUKI GOSEI KOGYO. CO., LTD. ) as the hydrophobizing agent, is injected into the autoclave by an entrainer pump in advance. Then, the resultant is reacted at a temperature of 180° C. for 20 minutes, while the resultant is stirred. After that, the supercritical carbon dioxide is circulated and a residual solution of the treating agent is removed so as to obtain surface treated silica particles (S11).

Preparation of Surface Treated Silica Particles (SC1)

The surface treated silica particles (SC1) are prepared in the same manner as the surface treated silica particles (S1), except that the siloxane compound is not added in the preparation of the surface treated silica particles (S1).

Preparation of Surface Treated Silica Particles (SC2) to (SC4)

The surface treated silica particles (SC2) to (SC4) are prepared in the same manner as the surface treated silica particles (S1), except that the silica particle dispersion and a surface treatment condition (the treatment atmosphere, the siloxane compound (type, viscosity, and addition amount thereof), the hydrophobizing agent, and the addition amount thereof) are changed according to Table 3 in the preparation of the surface treated silica particles (S1).

Preparation of Surface Treated Silica Particles (SC5)

The surface treated silica particles (SC5) are prepared in the same manner as the surface treated silica particles (S6), except that the siloxane compound is not added in the preparation of the surface treated silica particles (S6).

Preparation of Surface Treated Silica Particles (SC6)

After the silica particle dispersion (8) is filtrated and dried at a temperature of 120° C., the resultant is put into an electric furnace and baked at a temperature of 400° C. for 6 hours. Then, 10 parts of HMDS is sprayed with respect to the silica particles by a spray drier and dried, thereby fabricating the surface treated silica particles (SC6).

Physical Properties of Surface Treated Silica Particles

With respect to the obtained surface treated silica particles, the average equivalent circle diameter, the average circularity, the attachment amount of the siloxane compound to the untreated silica particles (in Tables, written as "surface attachment amount"), the compression aggregation degree, the particle compression ratio, and the particle dispersion degree are measured by the above methods.

Hereinafter, Table 2 and Table 3 show a list of details of the surface treated silica particles. In addition, the abbreviation in Table 2 and Table 3 are as follows.

DSO: dimethyl silicone oil

HMDS: hexamethyl disilazane

TABLE 2

| | | Surface treatment coridition | | | | | Physical properties of surface treated silica particles | | | | | |
|---|---|---|---|---|---|---|---|---|---|---|---|---|
| | | Siloxane compound | | | | | | | | | | |
| Surface treated silica particles | Silica particle dispersion | Type | Viscosity (cSt) | Addition amount (parts) | Treatment atmosphere | Hydrophobizing agent/the number of parts | Average equivalent circle diameter (nm) | Average circularity | Surface attachment amount (% by weight) | Compression aggregation degree (%) | Particle Compression ratio | Particle dispersion degree (%) |
| (S1) | (1) | DSO | 10,000 | 0.3 parts | Supercritical $CO_2$ | HMDS/20 parts | 120 | 0.958 | 0.28 | 85 | 0.310 | 98 |
| (S2) | (1) | DSO | 10,000 | 1.0 part | Supercritical $CO_2$ | HMDS/20 parts | 120 | 0.958 | 0.98 | 92 | 0.280 | 97 |
| (S3) | (1) | DSO | 5,000 | 0.15 parts | Supercritical $CO_2$ | HMDS/20 parts | 120 | 0.958 | 0.12 | 80 | 0.320 | 99 |
| (S4) | (1) | DSO | 5,000 | 0.5 parts | Supercritical $CO_2$ | HMDS/20 parts | 120 | 0.958 | 0.47 | 88 | 0.295 | 98 |
| (S5) | (2) | DSO | 10,000 | 0.2 parts | Supercritical $CO_2$ | HMDS/20 parts | 140 | 0.962 | 0.19 | 81 | 0.360 | 99 |
| (S6) | (1) | DSO | 10,000 | 1.0 part | Air | HMDS/80 parts | 120 | 0.958 | 0.50 | 83 | 0.380 | 93 |
| (S7) | (3) | DSO | 10,000 | 0.3 parts | Supercritical $CO_2$ | HMDS/20 parts | 130 | 0.850 | 0.29 | 68 | 0.350 | 92 |
| (S8) | (4) | DSO | 10,000 | 0.3 parts | Supercritical $CO_2$ | HMDS/20 parts | 90 | 0.935 | 0.29 | 94 | 0.390 | 95 |
| (S9) | (1) | DSO | 50,000 | 1.5 parts | Supercritical $CO_2$ | HMDS/20 parts | 120 | 0.958 | 1.25 | 95 | 0.240 | 91 |
| (S10) | Fumed Silica OX50 | DSO | 10,000 | 0.3 parts | Supercritical $CO_2$ | HMDS/20 parts | 80 | 0.680 | 0.26 | 84 | 0.395 | 92 |
| (S11) | Fumed Silica A50 | DSO | 10,000 | 1.0 parts | Supercritical $CO_2$ | HMDS/40 parts | 45 | 0.880 | 0.91 | 88 | 0.276 | 91 |
| (S12) | (3) | DSO | 5,000 | 0.04 parts | Supercritical $CO_2$ | HMDS/20 parts | 130 | 0.850 | 0.02 | 62 | 0.360 | 96 |
| (S13) | (3) | DSO | 1,000 | 0.5 parts | Supercritical $CO_2$ | HMDS/20 parts | 130 | 0.850 | 0.46 | 90 | 0.380 | 92 |
| (S14) | (3) | DSO | 10,000 | 5.0 parts | Supercritical $CO_2$ | HMDS/20 parts | 130 | 0.850 | 4.70 | 95 | 0.360 | 91 |
| (S15) | (5) | DSO | 10,000 | 0.5 parts | Supercritical $CO_2$ | HMDS/20 parts | 185 | 0.971 | 0.43 | 61 | 0.209 | 96 |
| (S16) | (6) | DSO | 10,000 | 0.5 parts | Supercritical $CO_2$ | HMDS/20 parts | 164 | 0.97 | 0.41 | 64 | 0.224 | 97 |
| (S17) | (7) | DSO | 10,000 | 0.5 parts | Supercritical $CO_2$ | HMDS/20 parts | 210 | 0.978 | 0.44 | 60 | 0.205 | 98 |

TABLE 3

| Surface treated silica particles | Silica particle dispersion | Surface treatment coridition: Siloxane compound: Type | Vis-cosity (cSt) | Addition amount (parts) | Treatment atmosphere | Hydrophobizing agent/the number of parts | Physical properties of surface treated silica particles: Average equivalent circle diameter (nm) | Average circularity | Surface attachment amount (% by weight) | Compression aggregation degree (%) | Particle Compression ratio | Particle dispersion degree (%) |
|---|---|---|---|---|---|---|---|---|---|---|---|---|
| (SC1) | (1) | — | — | — | Supercritical $CO_2$ | HMDS/20 parts | 120 | 0.958 | — | 55 | 0.415 | 99 |
| (SC2) | (1) | DSO | 100 | 3.0 parts | Supercritical $CO_2$ | HMDS/20 parts | 120 | 0.958 | 2.5 | 98 | 0.450 | 75 |
| (SC3) | (1) | DSO | 1000 | 8.0 parts | Supercritical $CO_2$ | HMDS/20 parts | 120 | 0.958 | 7.0 | 99 | 0.360 | 83 |
| (SC4) | (3) | DSO | 3000 | 10 parts | Supercritical $CO_2$ | HMDS/20 parts | 130 | 0.850 | 8.5 | 99 | 0.380 | 85 |
| (SC5) | (1) | — | — | — | Air | HMDS/80 parts | 120 | 0.958 | — | 62 | 0.425 | 98 |
| (SC6) | (8) | — | — | — | Air | HMDS/10 parts | 300 | 0.980 | — | 60 | 0.197 | 93 |

Preparation of Carrier (1) Formation of Core

The core is formed by the following method.

Preparation of Magnetic Member Particles A

After 500 parts of magnetite particles having an average particle diameter of 0.27 μm are put into HENSCHEL MIXER and stirred sufficiently, 5.0 parts of a silane coupling agent is added thereto and the temperature is increased to 100° C., stirred and mixed sufficiently for 30 minutes. Then, magnetic member particles A of magnetite coated with the silane coupling agent are obtained.

Preparation of Magnetic Member Particles B

After 100 parts of magnetite particles having an average particle diameter of 0.7 μm are put into HENSCHEL MIXER and stirred sufficiently, 0.03 parts of a silane coupling agent is added thereto and the temperature is increased to 100° C., stirred and mixed sufficiently for 30 minutes. Then, magnetic member particles B of magnetite coated with the silane coupling agent are obtained.

Preparation of Core Particles (1)

Next, 60 parts of phenol, 90 parts of 37% formalin, 420 parts of the lipophilically treated magnetic member particles A, 16 parts of 28% ammonia aqueous solution, and 40 parts of water are stirred and mixed in 1 L four necked flask. Subsequently, after the resultant is heated up to a temperature of 45° C. for 30 minutes while the resultant is stirred, the number of revolutions of the stirring impeller is reduced while the state within the flask is observed, 7 parts of the magnetic member particles B and 10 parts of water are added thereto, the number of revolutions are increased up to the initial number of revolutions after the addition is finished, the temperature is increased up to 85° C. for 30 minutes, and the resultant is reacted at the same temperature for 180 minutes. After that, the temperature is cooled down to 25° C. and 500 ml of water is added to the resultant. Then, a supernatant liquid is removed and a precipitate is washed with water. The resultant is dried by air under evacuation and the core particles (1) are obtained.

(2) Formation of Resin Layer

A resin layer is formed on the surface of the core according to the following method.

Preparation of a Material Solution (a) for Forming a Coating Layer

The components of the following composition are stirred dispersed by a stirrer for 60 minutes and the material solution (a) for forming a coating layer is prepared.

Toluene: 85 parts

Styrene-methacrylate copolymer (weight ratio of 90:10): 12 parts

Carbon black (R330, manufactured by Cabot Corporation): 4 parts

Preparation of Carrier CA1

100 parts of the core particles (1) and 12 parts of the material solution for forming a coating layer (a) are put into a vacuum degassing type kneader, and the resultant is evacuated down to −200 mmHg at a temperature of 60° C. and mixed for 15 minutes, while the resultant is stirred. Then, the resultant is heated and evacuated, and the resultant is stirred and dried at a temperature of 94° C. and a pressure of −720 mmHg for 30 minutes so as to obtain resin coated particles. Next, the particles are sieved by a sieving net having a mesh of 75 μm to obtain a carrier CA1.

Preparation of Carrier CA2

The core particles (2) are prepared according to the same method except that the addition amount of the magnetic member particles B is changed to 10 parts in the preparation of the core particles (1).

In addition, the carrier CA2 is obtained according to the same method except that the core particles (2) are used as the core particles and the addition amount of the material solution for forming a coating layer (a) is changed to 14 parts in the preparation of the carrier CA1.

Preparation of Carrier CA3

The core particles (3) are prepared according to the same method except that the magnetite particles having an average particle diameter of 0.7 μm is change to the magnetite particles having an average particle diameter of 0.8 μm the preparation of the magnetic member particles B, and the addition amount of the magnetic member particles B is changed to 13 parts in the preparation of the core particles (1).

In addition, the carrier CA3 is obtained according to the same method except that the core particles (3) are used as the core particles in the preparation of the carrier CA2.

Preparation of Carrier CA4

The core particles (4) are prepared according to the same method except that the magnetite particles having an average particle diameter of 0.7 μm is change to the magnetite particles having an average particle diameter of 4 μm in the preparation of the magnetic member particles B, and the addition amount of the magnetic member particles B is changed to 15 parts in the preparation of the core particles (1).

In addition, the carrier CA4 is obtained according to the same method except that the core particles (4) are used as the core particles in the preparation of the carrier CA2.

Preparation of Carrier CA5

The core particles (5) are prepared according to the same method except that the magnetite particles having an average particle diameter of 0.7 μm is change to the magnetite particles having an average particle diameter of 4.8 μm in the preparation of the magnetic member particles B, and the addition amount of the magnetic member particles B is changed to 15 parts in the preparation of the core particles (1).

In addition, the carrier CA5 is obtained according to the same method except that the core particles (5) are used as the core particles in the preparation of the carrier CA1.

Preparation of Carrier CA6

The core particles (6) are prepared according to the same method except that the magnetite particles having an average particle diameter of 0.7 μm is change to the magnetite particles having an average particle diameter of 0.3 μm in the preparation of the magnetic member particles B, and the addition amount of the magnetic member particles B is changed to 10 parts in the preparation of the core particles (1).

In addition, the carrier CA6 is obtained according to the same method except that the core particles (6) are used as the core particles in the preparation of the carrier CA1.

Preparation of Carrier CA7

The core particles (7) are prepared according to the same method except that the magnetite particles having an average particle diameter of 0.7 μm is change to the magnetite particles having an average particle diameter of 5.2 μm in the preparation of the magnetic member particles B, and the addition amount of the magnetic member particles B is changed to 15 parts in the preparation of the core particles (1).

In addition, the carrier CA7 is obtained according to the same method except that the core particles (7) are used as the core particles in the preparation of the carrier CA1.

The measurement results of the core surface roughness Ra (referred to as "Ra1"), the particle diameter range of the core outermost layer portion, and the resin layer surface roughness Ra (referred to as "Ra2") of the above carriers CA1 to CAS are shown in Table.

TABLE 4

| | Core | | |
|---|---|---|---|
| Carrier type | Ra1 [μm] | Particle range of outermost layer portion [μm] | Coating layer (resin layer) Ra2 [μm] |
| CA1 | 0.5 | 0.8 | 0.36 |
| CA2 | 0.4 | 0.7 | 0.30 |
| CA3 | 0.3 | 0.7 | 0.25 |
| CA4 | 0.4 | 4.0 | 0.31 |
| CA5 | 0.5 | 4.8 | 0.39 |
| CA6 | 0.2 | 0.3 | 0.20 |
| CA7 | 0.8 | 5.2 | 0.51 |

Examples 1 to 23 and Comparative Examples 1 to 8

The silica particles shown in Table 5 are added to 100 parts of the toner particles shown in Table 5 according to the number of parts shown in Table 5, and the resultant is mixed by HENSCHEL MIXER at 2,000 rpm for 3 minutes, thereby obtaining a toner of each example.

In addition, the obtained each toner and the carrier shown in Table 5 are put into a V blender at a ratio of toner: carrier=5:95 (weight ratio) and stirred for 20 minutes, thereby obtaining a developer.

Evaluations

The deletion (image defect) and color streaks at the end of an image of the toner are evaluated with respect to the developer obtained in each example. In addition, the attachment degree of the silica particles flaked from the toner to the carrier is evaluated. The results are shown in Table 5.

Deletion (Image Defect) at the End of Image

According to the following method, the degree of occurrence of the deletion (image defect) at the end of an image at the initial period and the state of occurrence of the color streaks after running for a long period of time are evaluated.

Deletion (Image Defect)

A modified apparatus of DocuCentre IV5570 manufactured by Fuji Xerox Co., Ltd. including the obtained developer is placed in an environment of 10° C./RH10% for 3 days and an image having an image density of 1% is printed on 100 pieces of A4 paper. Then, an evaluation chart in which a solid image is combined with a halftone image is printed on 10 pieces of paper, and the degree of the deletion at the rear end of the solid image is visually confirmed.

The evaluation standard is as follows.

A: Deletion is hardly observed

B: Deletion is slightly observed (the rear end is white and it is observed as foggy)

C: Deletion may be confirmed (width of the deletion≤1 mm)

D: Deletion may be remarkably confirmed (width of the deletion>1 mm)

Evaluation of Image Concentration Decrease

A solid image is printed using a modified apparatus of Apeorport IV C5570 manufactured by Fuji Xerox Co., Ltd. including the obtained developer, an initial image concentration (SAD) is confirmed by using a reflection densitometer (X-RITE938) manufactured by X-Rite Inc. Then, printing is performed at an image density of 1% in an environment of 30° C./RH80% on the 15,000 pieces of paper, and then printing is performed at an image density of 100% in an environment of 15° C./RH20% on the 10 pieces of paper, and the image concentration of 5 points per one piece is measured. The average SAD is calculated and the decreasing degree from the initial SAD is measured.

The evaluation standard is as follows.

A: A decrease in concentration is hardly observed (ΔSAD ≤0.05)

B: A decrease in concentration is slightly observed, but there is no problem in practical use (0.05<ΔSAD≤0.10)

C: A decrease in concentration is observed, but there is no problem in practical use (0.10<ΔSAD≤0.20)

D: A decrease in concentration is remarkably observed (ΔSAD>0.20)

Attachment amount of silica particles flaked from toner to carrier

In the above evaluation test, the initial attachment amount of the silica particles flaked from the toner to the carrier is evaluated according to the following evaluation method.

The tested developer is put into a gauge with a mesh of an aperture of 20 μm and the toner and the carrier are separated by air blowing. The Si element content of the obtained carrier is measured using XRF1500, which is an X-ray fluorescence measuring apparatus manufactured by Shimazu Corporation and the Net strength of the Si element is obtained. A value obtained by subtracting the Net strength obtained by measuring the Si element content of the carrier only from the obtained Net strength is regarded as a movement amount of the silica to the carrier, and the value is evaluated according to the following standard.

A: Movement amount to the carrier≤0.5

B: 0.5<Movement amount to the carrier≤0.8

C: 0.8<Movement amount to the carrier≤1.0

D: Movement, amount to the carrier>1.0

TABLE 5

| | | Developer | | | | Evaluation | | | |
|---|---|---|---|---|---|---|---|---|---|
| | | Toner particles | Surface treated silica particies Types | The number of parts | Carrier | Degree of image defect occurrence | Attachment degree of flaked silica particles to carrier (initial) | Decreasing degree of image concentration | Attachment degree of flaked silica particles to carrier over time) |
| Examples | 1 | (1) | S1 | 1.0 | CA1 | A | A | A | A |
| | 2 | (1) | S2 | 1.0 | CA1 | A | A | A | A |
| | 3 | (1) | S3 | 1.0 | CA1 | A | A | A | A |
| | 4 | (1) | S4 | 1.0 | CA1 | A | A | A | A |
| | 5 | (1) | S5 | 1.0 | CA1 | B | B | B | B |
| | 6 | (1) | S6 | 1.0 | CA1 | A | A | A | A |
| | 7 | (1) | S7 | 1.0 | CA1 | B | B | B | B |
| | 8 | (1) | S8 | 1.0 | CA1 | A | A | A | A |
| | 9 | (1) | S9 | 1.0 | CA1 | A | A | A | A |
| | 10 | (1) | S10 | 1.0 | CA1 | A | A | A | A |
| | 11 | (1) | S11 | 1.0 | CA1 | C | B | C | C |
| | 12 | (1) | S12 | 1.0 | CA1 | C | C | B | B |
| | 13 | (1) | S13 | 1.0 | CA1 | B | B | B | B |
| | 14 | (1) | S14 | 1.0 | CA1 | A | A | A | A |
| | 15 | (1) | S15 | 1.0 | CA1 | C | C | C | C |
| | 16 | (1) | S16 | 1.0 | CA1 | C | C | C | C |
| | 17 | (1) | S17 | 1.0 | CA1 | C | C | C | C |
| | 18 | (1) | S1 | 1.0 | CA2 | B | B | B | B |
| | 19 | (1) | S1 | 1.0 | CA3 | C | C | C | C |
| | 20 | (1) | S1 | 1.0 | CA4 | B | B | B | B |
| | 21 | (1) | S1 | 1.0 | CA5 | A | A | C | B |
| | 22 | (1) | S1 | 0.1 | CA1 | A | A | A | A |
| | 23 | (1) | S1 | 6.0 | CA1 | C | C | C | C |
| Comparative Examples | 1 | (1) | SC1 | 1.0 | CA1 | D | D | D | D |
| | 2 | (1) | SC2 | 1.0 | CA1 | D | D | D | D |
| | 3 | (1)) | SC3 | 1.0 | CA1 | D | D | D | D |
| | 4 | (1) | SC4 | 1.0 | CA1 | D | D | D | D |
| | 5 | (1) | SC5 | 1.0 | CA1 | D | D | D | D |
| | 6 | (1) | SC6 | 1.0 | CA1 | D | D | D | D |
| | 7 | (1) | S1 | 1.0 | CA6 | D | D | B | B |
| | 8 | (1) | S1 | 1.0 | CA7 | A | A | D | D |

From the above result, it is understood that occurrence of the deletion (image defect) is prevented in Examples, compared to Comparative Examples.

In particular, it is understood that in Examples 1 to 5, 14, and 18 to 23 in which the silica particles having the compression aggregation degree of 70% to 95% and the particle compression ratio of 0.28 to 0.36 are applied as the external additive, occurrence of the deletion (image defect) and the color streaks at the end of an image are prevented compared to other Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising:

an electrostatic charge image developing toner that includes toner particles, and an external additive which is added to the toner particles and which includes silica particles whose compression aggregation degree is from 60% to 95% and particle compression ratio is from 0.20 to 0.40; and a carrier for developing an electrostatic charge image that has a core including a magnetic member in a binder resin for a core, and a coating layer which covers a surface of the core and which includes a resin for a coating layer and has a surface roughness Ra of from 0.25 μm to 0.4 μm.

2. The electrostatic charge image developer according to claim 1, wherein an average equivalent circle diameter of the silica particles is from 40 nm to 200 nm.

3. The electrostatic charge image developer according to claim 1, wherein a particle dispersion degree of the silica particles is from 90% to 100%.

4. The electrostatic charge image developer according to claim 1, wherein an average circularity of the silica particles is from 0.85 to 0.98.

5. The electrostatic charge image developer according to claim 1, wherein the silica particles are sol gel silica particles.

6. The electrostatic charge image developer according to claim 1, wherein the silica particles are surface-treated with a siloxane compound whose viscosity is from 1,000 cSt to 50,000 cSt, and a surface attachment amount of the siloxane compound is from 0.01% by weight to 5% by weight.

7. The electrostatic charge image developer according to claim 6, wherein the siloxane compound is a silicone oil.

8. The electrostatic charge image developer according to claim 1, wherein a surface roughness Ra of the core is from 0.3 μm to 0.5 μm.

9. The electrostatic charge image developer according to claim 1, wherein a thickness of the resin for a coating layer is from 0.1 μm to 3.0 μm.

10. The electrostatic charge image developer according to claim 1, wherein a ratio (Ra2/Ra1) of the surface roughness Ra2 of the carrier to the surface roughness Ra1 of the core is from 0.72 to 0.83.

11. The electrostatic charge image developer according to claim 1, wherein the resin for a coating layer includes conductive particles.

12. A developer cartridge comprising:

a container containing the electrostatic charge image developer according to claim 1, wherein the developer cartridge is detachable from an image forming apparatus.

13. A process cartridge comprising:

a developing unit that contains the electrostatic charge image developer according to claim 1 and develops an electrostatic charge image formed on a surface of an image holding member by the electrostatic charge image developer to thereby obtain a toner image, wherein the process cartridge is detachable from an image forming apparatus.

* * * * *